US012226022B2

(12) United States Patent
Mallory et al.

(10) Patent No.: US 12,226,022 B2
(45) Date of Patent: Feb. 18, 2025

(54) CRIB ACCESSORY

(71) Applicant: Slumberpod LLC, Bellevue, WA (US)

(72) Inventors: Kathryn Beck Mallory, Decatur, GA (US); Louise Wingfield Childs, Milledgeville, GA (US); Maureen Carroll, Atlanta, GA (US); Stephen Jones, Doraville, GA (US); Jeffrey Juskowich, Murfreesboro, TN (US)

(73) Assignee: Slumberpod LLC, Bellevue, WA (US)

( * ) Notice: Subject to any disclaimer, the term of this patent is extended or adjusted under 35 U.S.C. 154(b) by 0 days.

(21) Appl. No.: 18/800,785

(22) Filed: Aug. 12, 2024

(65) Prior Publication Data

US 2024/0398131 A1 Dec. 5, 2024

Related U.S. Application Data

(63) Continuation of application No. 18/182,923, filed on Mar. 13, 2023, which is a continuation of application (Continued)

(51) Int. Cl.
*A47C 29/00* (2006.01)
*A47D 7/00* (2006.01)

(Continued)

(52) U.S. Cl.
CPC ..... *A47C 29/003* (2013.01); *A47D 7/00* (2013.01); *A47D 9/00* (2013.01); *E04H 15/324* (2013.01);

(Continued)

(58) Field of Classification Search
CPC ..... A47C 29/003; A47D 7/00; A47D 7/002; A47D 7/005; A47D 7/04; A47D 9/00;

(Continued)

(56) References Cited

U.S. PATENT DOCUMENTS 1,134,009 A 3/1915 Reid
2,666,441 A 1/1954 Powers (Continued)

FOREIGN PATENT DOCUMENTS

EP 1741366 1/2007

OTHER PUBLICATIONS https://www.snoozeshade.com/collections/cot-shades, accessed Apr. 27, 2020 (also available Aug. 20, 2016).

(Continued)

*Primary Examiner* — David R Hare
(74) *Attorney, Agent, or Firm* — PABST PATENT GROUP LLP

(57) ABSTRACT

A pop up cover for a crib is provided for providing a safe, comfortable and isolated environment for a child in a crib. The pop-up cover may be made of breathable fabric panels having an integrated frame, for example a flexible frame, which can be folded (collapsed) on itself, for example when folded in specific ways if appropriate force is applied and which keeps the fabric in a taught, open position when unfolded (preventing the panels form falling inwards onto each other). The pop up cover can be lightweight and compact, quick and easy to set up, dark inside and breathable.

20 Claims, 17 Drawing Sheets

Related U.S. Application Data

No. 17/466,382, filed on Sep. 3, 2021, now Pat. No. 11,617,450, which is a continuation of application No. 15/692,509, filed on Aug. 31, 2017, now Pat. No. 11,140,997.

(60) Provisional application No. 62/509,864, filed on May 23, 2017, provisional application No. 62/382,228, filed on Aug. 31, 2016.

(51) Int. Cl.

| | |
|---|---|
| ***A47D 9/00*** | (2006.01) |
| ***E04H 15/00*** | (2006.01) |
| ***E04H 15/10*** | (2006.01) |
| ***E04H 15/14*** | (2006.01) |
| ***E04H 15/32*** | (2006.01) |

(52) U.S. Cl.
CPC ..... *A47D 7/002* (2013.01); *E04H 15/00* (2013.01); *E04H 15/10* (2013.01); *E04H 15/14* (2013.01)

(58) Field of Classification Search
CPC ..... A47D 9/005; A47D 9/02; E04H 15/00; E04H 15/10; E04H 15/14; E04H 15/324
USPC ..... 5/93.1, 98.1, 113
See application file for complete search history.

(56) References Cited

U.S. PATENT DOCUMENTS 2,731,972 A 1/1956 Braun
2,782,794 A 2/1957 White
2,840,093 A 6/1958 Roe
3,173,435 A 3/1965 Julien
3,546,721 A 12/1970 Morency
3,990,463 A 11/1976 Norman
4,065,166 A 12/1977 Shoemaker
4,129,139 A 12/1978 Powers
4,236,543 A 12/1980 Moss
4,489,451 A 12/1984 Neely
4,641,387 A 2/1987 Bondy
D289,787 S 5/1987 Eppenbach
4,745,936 A 5/1988 Scherer
D298,787 S 12/1988 Greene
4,790,340 A * 12/1988 Mahoney ..... A47D 13/06 135/96
4,825,892 A 5/1989 Norman
4,827,958 A 5/1989 Cantwell
4,862,534 A 9/1989 Gomez-Marcial
4,901,481 A * 2/1990 Seeley, Jr. ..... E04H 15/20 52/2.15
4,945,584 A 8/1990 Lamantia
4,951,333 A 8/1990 Kaiser
5,059,463 A 10/1991 Peters
5,061,235 A 10/1991 Hogan
5,067,505 A 11/1991 Cantwell
5,078,096 A * 1/1992 Bishop ..... E04H 15/40 119/497
5,088,740 A 2/1992 Peterson
5,137,044 A 8/1992 Brady
5,207,508 A 5/1993 Koutsis, Jr.
5,273,142 A 12/1993 Weber
5,370,145 A * 12/1994 Wu ..... E04H 15/425 135/905
5,439,017 A 8/1995 Brown
5,517,707 A * 5/1996 LaMantia ..... A47C 29/003 135/96
D372,953 S 8/1996 Florez
5,590,674 A 1/1997 Eppenbach
5,676,168 A 10/1997 Price
5,725,426 A 3/1998 Alvarez
5,881,678 A 3/1999 Morley
5,930,854 A 8/1999 O'Neill
6,092,544 A 7/2000 Zheng
6,109,280 A * 8/2000 Custer ..... A47D 15/00 5/98.1
6,123,091 A 9/2000 Flynn
6,131,217 A 10/2000 Kasem
6,199,229 B1 3/2001 Wong
6,216,291 B1 4/2001 Eads
6,216,715 B1 4/2001 Howe
D444,840 S 7/2001 Glover
6,263,894 B1 7/2001 LaMantia
6,302,127 B1 10/2001 Gayton
6,371,143 B1 4/2002 Swetish
6,425,150 B1 7/2002 Cheng
6,467,107 B1 10/2002 Glover
6,487,735 B1 * 12/2002 Jacques ..... A61G 10/005 5/512
6,510,565 B1 * 1/2003 Zwezdaryk ..... A61H 33/06 135/92
6,546,574 B1 4/2003 Bader
6,550,083 B1 4/2003 LaMantia
6,644,329 B2 * 11/2003 Tomason ..... E04H 15/02 135/96
7,040,333 B1 * 5/2006 Ransom ..... E04H 15/32 135/901
7,096,874 B2 * 8/2006 Forshpan ..... A47D 15/00 135/117
7,152,733 B2 12/2006 Trickett
7,174,584 B2 2/2007 Danaher
7,201,177 B2 * 4/2007 Anticoli ..... E04H 15/40 135/124
7,376,993 B2 5/2008 Myers
7,430,770 B2 10/2008 Ramirez
7,644,720 B2 1/2010 Chen
7,735,167 B2 6/2010 Kline
7,793,368 B2 9/2010 Burrell, IV
7,905,242 B2 * 3/2011 Kline ..... A47C 21/08 135/96
7,954,504 B2 * 6/2011 Price ..... E04H 15/425 135/156
7,971,596 B2 7/2011 Morris
8,056,572 B2 * 11/2011 Livacich ..... A01M 31/025 135/147
8,087,110 B1 1/2012 Park
8,256,044 B1 9/2012 Park
8,893,335 B1 11/2014 Hijuelos
D818,754 S 5/2018 Lovell
10,138,653 B1 11/2018 Weber
10,208,499 B2 2/2019 Lovell
10,557,282 B1 2/2020 Flannery
10,837,194 B2 11/2020 Ruggiero
10,905,254 B2 * 2/2021 Gutman ..... A47C 15/008
D919,738 S 5/2021 Chaklos
11,140,997 B2 10/2021 Mallory
11,406,198 B2 8/2022 Mallory
11,617,450 B2 * 4/2023 Mallory ..... A47C 29/003 5/93.1
2002/0020439 A1 2/2002 Tate
2002/0139408 A1 10/2002 Mitzner
2004/0099301 A1 * 5/2004 Zhang ..... E04H 15/28 5/97
2007/0061965 A1 3/2007 Crawford
2007/0271698 A1 11/2007 Cyr
2008/0190471 A1 8/2008 Tarter
2010/0083995 A1 4/2010 Sanders
2013/0192653 A1 8/2013 Watson
2013/0291918 A1 * 11/2013 Lovell ..... A47D 7/007 135/121
2014/0224288 A1 * 8/2014 Mear ..... E04H 15/324 135/96
2015/0028173 A1 1/2015 Randel
2015/0121617 A1 5/2015 Ball
2015/0121618 A1 5/2015 Svei
2016/0242567 A1 8/2016 Lime
2018/0042397 A1 * 2/2018 Brereton ..... A47C 29/003
2018/0320294 A1 11/2018 Hightower, III
2018/0320394 A1 11/2018 Reaves

(56) References Cited

U.S. PATENT DOCUMENTS

| | | | |
|---|---|---|---|
| 2019/0099011 | A1 | 4/2019 | Ling |
| 2020/0069075 | A1 | 3/2020 | Gutman |
| 2024/0041222 | A1 | 2/2024 | Mallory |

OTHER PUBLICATIONS https://www.kidco.com/product/peapod-plus/, accessed Apr. 27, 2020 (also available Aug. 20, 2016).
Sy, "Products and Tips for Tent Camping with Babies", Reality Daydream, https://realitydaydream.com/ products-and-tips-for-tent-camping-with-babies, accessed Jan. 13, 2021.
REI Half Dome 2 Tent Setup and Review, Celysestroh, 18:13 (2016) https://www.youtube.com/watch?v=fAdHy_CH7II.

* cited by examiner

CROSS-LOOP

Folded

MESH TENT

X-TENT

CROSS-LOOP2

Exterior View

Before legs are deployed

Legs deployed

CRIB ACCESSORY

CROSS REFERENCE TO RELATED APPLICATIONS

This application is a continuation of U.S. application Ser. No. 18/182,923, filed Mar. 13, 2023, which is a continuation of U.S. application Ser. No. 17/466,382, filed Sep. 3, 2021 (now U.S. Pat. No. 11,617,450), which is a continuation of U.S. application Ser. No. 15/692,509, filed Aug. 31, 2017 (now U.S. Pat. No. 11,140,997), which claims priority to, and the benefit of, U.S. Application No. 62/382,228, filed Aug. 31, 2016, and U.S. Application No. 62/509,864, filed May 23, 2017, all of which are hereby incorporated by reference in their entireties.

FIELD OF THE DISCLOSURE

The disclosure relates to crib accessories. More specifically, this disclosure relates to devices for isolating a crib or bed within a room. The disclosure also relates to a self-supporting, portable, collapsible, pop-up pod that is sized to fit over most cribs and portable cribs/play yards.

BACKGROUND

Travelling with babies often results in little and/or poor, disrupted sleep for parents and baby alike, especially when the family shares a room such as a hotel room. It is estimated that a majority of babies who sleep well at home nevertheless have difficulty sleeping when traveling. Often hotel or guest rooms are not conducive to a baby's sleep resulting in parents also sleeping less. For example, when a family shares a single room when traveling, noise from others may disturb the baby and cause her to wake up. Further, when the baby wakes up and sees her parents in the same room, she may not want to go back to sleep. Also, the room itself may not be dark enough to help the baby go to sleep and stay asleep.

Families tend to approach this problem with desperation by putting the baby to sleep in the hotel bathroom or closet, spending additional money to rent a suite or adjoining room, resorting to possible unsafe solutions such as covering the crib with a sheet, or even avoiding traveling altogether.

U.S. patent application Ser. No. 13/763,578 relates to a bed tent with a bottom that encapsulates a mattress. That is, the bed tent requires the mattress to be placed inside the tent and as such is not compatible with crib use.

The SnoozeShade Breathable Play-yard Canopy, as shown on the Amazon.com website, is a polyester mesh fabric that fits tightly around portable play-yards. A baby cannot stand in the play-yard with the SnoozeShade in place and closed. Furthermore, because the product is akin to a fitted sheet for the outside of a play-yard, it cannot be used as a one-size fits all solution.

SUMMARY

The present disclosure primarily provides a bottomless enclosure (also referred to as a pod) for cribs (although it may also be adapted to work with toddler and adult beds, pet crates or cages, or other bedding arrangements). In some embodiments, the pod is "one-size-fits-all" and is sized to fit over the largest cribs but may nevertheless also be used with smaller cribs and portable play-yards.

In some or further embodiments the pod is self-supporting, yet reversibly collapsible and portable. That is, for example, the pod, which may be made of fabric panels and an integral structural frame, may be folded down into a small size for storage, for example in a small pouch, and/or, when unfolded results in the privacy pod "popping up" and the fabric panels remaining taught.

In some embodiments, the pod is made of material that enhances privacy, for example the material is light-limiting, including light-blocking and therefore limits light from entering the structure thus providing a darkened environment.

In some embodiments, the pod may have a removable top, and/or portions of fabric, which may be rolled away (for example unzippered) to create a window.

In effect, in some embodiments, the pod creates a "room within a room"; that is, the pod serves as a separate room for a child to sleep within the larger room that the pod occupies (such as a hotel room).

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims. In addition, all optional and preferred features and modifications of the described embodiments are usable in all aspects of the disclosure taught herein. Furthermore, the individual features of the dependent claims, as well as all optional and preferred features and modifications of the described embodiments are combinable and interchangeable with one another.

BRIEF DESCRIPTION OF DRAWINGS

Non-limiting examples of slumber pods are described with reference to the following figures. The same numbers may be used throughout the figures to reference like features and components.

DESCRIPTION

Figure 1:
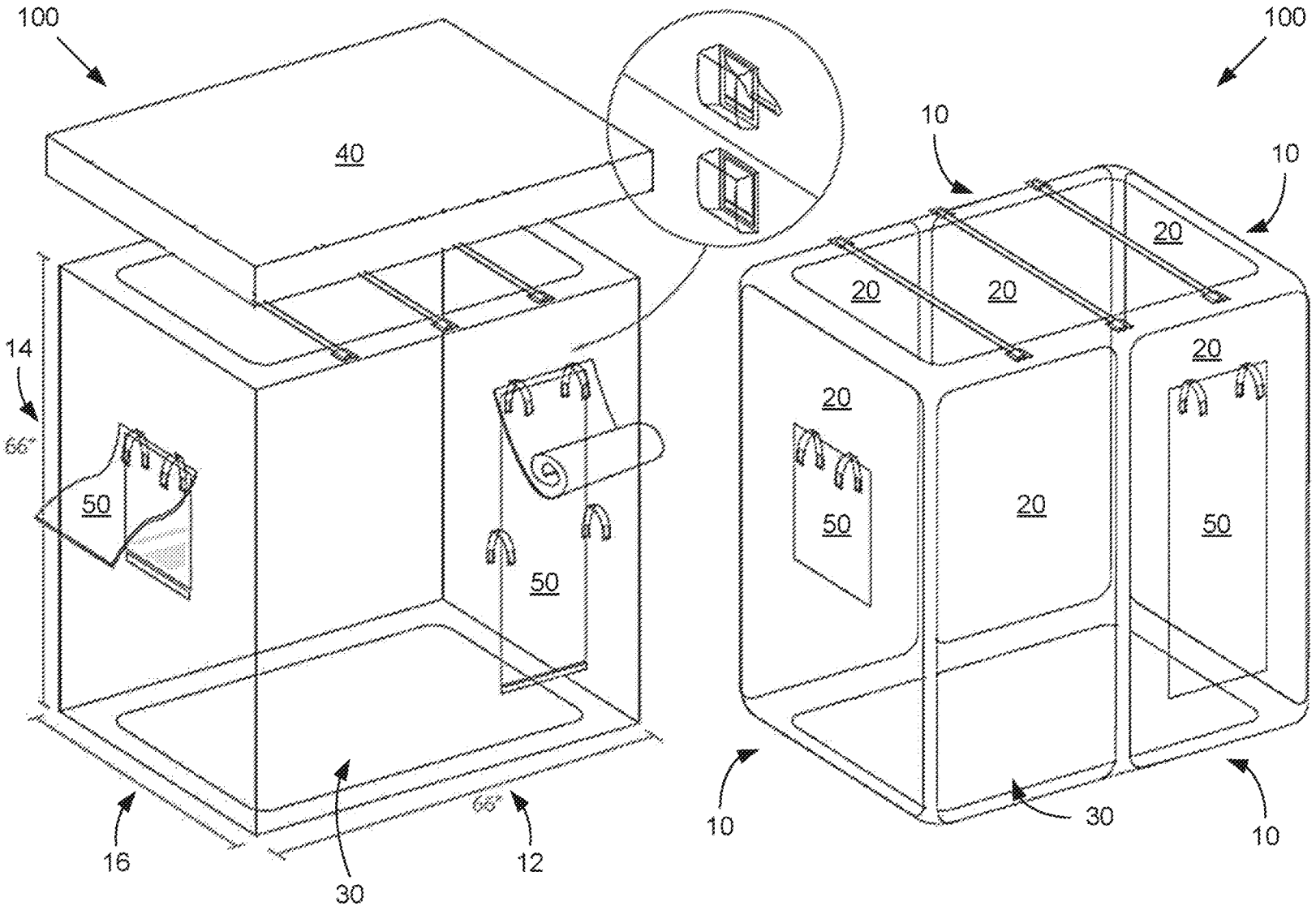
FIG. 1 is a graphical representation illustrating an example of a self-supporting, slumber pod, in accordance with various aspects of the present disclosure.

In the following detailed description, reference is made to the accompanying drawings, which form a part of the disclosure hereof, and within which are shown by way of illustration certain embodiments by which the subject matter of this disclosure may be practiced. It is understood that other embodiments may be utilized and structural changes may be made without departing from the scope of the disclosure. In other words, illustrative embodiments and aspects are described below. But it will of course be appreciated that in the development of any such actual embodiment, numerous implementation-specific decisions must be made to achieve the developer's specific goals, such as compliance with system-related and business-related constraints, which may vary from one implementation to another. Moreover, it will be appreciated that such development effort may be complex and time-consuming, but would nevertheless be a routine undertaking for those of ordinary skill in the art having the benefit of this disclosure.

Unless defined otherwise, all technical and scientific terms used herein have the same meaning as is commonly understood by one of ordinary skill in the art to which this disclosure belongs. In the event that there is a plurality of definitions for a term herein, those in this section prevail unless stated otherwise.

Wherever the phrases "for example," "such as," "including" and the like are used herein, the phrase "and without limitation" is understood to follow unless explicitly stated otherwise.

The terms "comprising" and "including" and "involving" (and similarly "comprises" and "includes" and "involves") are used interchangeably and mean the same thing. Specifically, each of the terms is defined consistent with the common United States patent law definition of "comprising" and is therefore interpreted to be an open term meaning "at least the following" and also interpreted not to exclude additional features, limitations, aspects, etc.

The term "about" is meant to account for variations due to experimental error or to permit deviations from the measurements that don't negatively impact the intended purpose. All measurements or numbers are implicitly understood to be modified by the word about, even if the measurement or number is not explicitly modified by the word about. The term "about" can include traditional rounding according to significant figures of numerical values. In addition, the phrase "about 'x' to 'y'" includes "about 'x' to about 'y'".

The term "substantially" is meant to permit deviations from the descriptive term that don't negatively impact the intended purpose. All descriptive terms are implicitly understood to be modified by the word substantially, even if the descriptive term is not explicitly modified by the word substantially.

Wherever the terms "a" or "an" are used, "one or more" is understood unless explicitly stated otherwise or such interpretation is nonsensical in context.

The term "pod" refers to a bottomless, tent-like structure.

"Self-supporting" when describing the pod means that the device can unfold and remain in its open position using only components that are integral to the pod, without the need for additional parts independent of the pod itself such as stakes and without the need for attachment to the crib or bed (as the case may be). For example, typical tents are provided as a fabric canopy with separate poles that must be inserted or attached to the canopy in order to hold up the tent. A "self-supporting" structure is one in which all that may be required to put up the structure is to open it or unfold it from its closed position. In some embodiments, the self-supporting pod automatically pops open once unfolded or unfolding is initiated.

"Collapsible" when used to describe the pod means that pod can be reversibly set up into its open, use position and returned to its closed, portable position, generally, generally only by unfolding and folding the slumber pod without removing the structural pod frame from the pod fabric.

The word "crib" means crib, baby bed, portable play-yard and similar beds designed for babies to sleep in unless expressly stated otherwise.

For purposes of this specification, "integral frame", "integrated frame" and the like refer to a frame which does not need to be removed from the fabric portion of the pod in order to collapse and fold the pod. In some embodiments, however, the frame may be optionally removable from the fabric portion of the enclosure. For example, the fabric enclosure may include sleeves for receiving frame pieces and into which the frame pieces may slide in and out. In other embodiments, for example, the frame may be attached to the pod fabric in a manner where it is not easily or not removable once attached.

The present disclosure relates to a device, referred to as a pod, for creating a "room within a room." That is, in its open, use position, the pod creates a smaller room located within a larger room. For example, when the pod is positioned over a crib it effectively creates a small room enclosing the crib within the larger room that the crib is located in. The small room essentially provides a private sleeping space within a larger room, for example for providing privacy for a crib within the larger room, such as a hotel room, in which the crib is located.

In some embodiments, the device is a portable, affordable solution for effectively isolating a child in a crib (usually a child of a size and weight suitable for sleeping in the desired crib) from other occupants in the room, which may facilitate good sleep for all family members. In some embodiments, the device may be used without having to bring along and set up a portable crib (play yard) when traveling and staying in hotels, or renting an extra room or suite in an effort to get a good night's sleep away from home. The device may also be used at home, for example, to isolate a baby in a crib when napping in the same room as the child to reduce the risk of waking the child and/or reduce the risk that the child won't go back to sleep if she wakes and sees her parents or others in the room with her.

In some embodiments, the pod is configured as a "one-size-fits-all" solution. That is, in some "one-size-fits-all" embodiments, the pod is sized large enough to fit over most cribs and play yards while still leaving enough room in the height for a suitable occupant, for example a baby or toddler that is size appropriate for the enclosed crib, to stand. In some other "one-size-fits-all" embodiments, the pod is manufactured so it can expand and contract to snugly fit over cribs of various sizes as better explained in conjunction with the drawings of the illustrated embodiments herein.

Referring now to the figures, where like elements are identified by like references numbers, FIG. 1 is an illustration of an example of a crib enclosure/pod 100 according to this disclosure. As shown, the pod 100 comprises a structure having 4 sides 10, six panels 20 and an open bottom 30. In the illustrated embodiment, the pod 100 is sized large enough to fit over most cribs and play yards while still leaving enough room in the height for a suitable occupant, for example a baby or toddler that is age and weight appropriate according to the specifications of the enclosed crib, to stand in the crib—and as such is a one-size-fits all crib enclosure solution. For example, as shown in FIG. 1, the length 12 of the pod may be about 66", the height 14 of the pod may be about 66" and the width 16 of the pod may be about 33". However, as a person of skill should appreciate, the dimensions of the slumber pod may vary to fit a proposed solution. For example, rather than being a "one-size-fits-all" solution, if desired, the dimensions may be tailored to more closely fit over a specific crib or play yard with less room between the boundaries of the crib and the sides of the pod. The dimensions may also be varied to fit over toddler and adult beds, pet crates, carriers or cages, or other bedding arrangements as can be appreciated.

Figure 3:
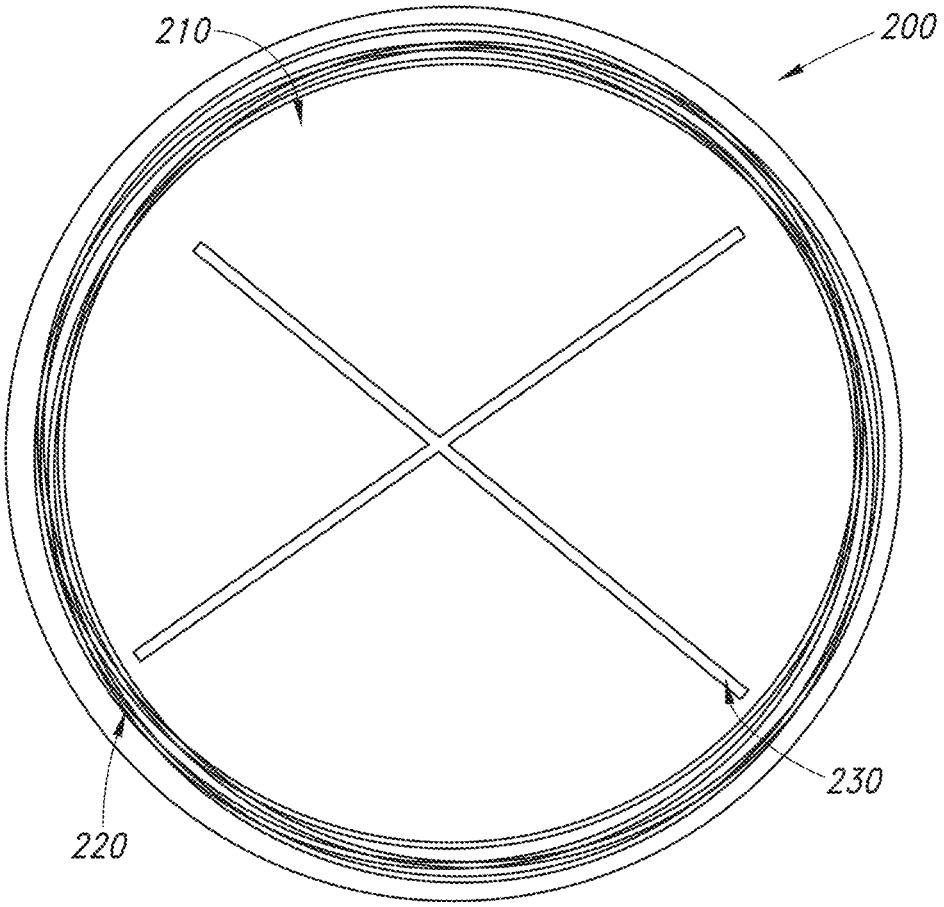
FIG. 3 is a graphical representation illustrating an example of a folded slumber pod of FIG. 2, in accordance with various aspects of the present disclosure.

As shown, the pod 100 is self-supporting. This is accomplished in the illustrated embodiment by integrating a frame with (for example within) the fabric sides 10 and/or panels 20. On the one hand, the frame is configured to cause the sides to remain in a taut when in the open, use position. On the other hand, in the illustrated embodiment, the frame is collapsible such that the slumber pod 100 may be folded onto itself into a small, portable size. For example, the pod 100 may be folded flat or it may be folded sufficiently small that it can fit into a bag having a diameter permitting it to be carried onto an airplane, for example having a diameter of about 20" or even about 25" or 26" as illustrated in FIG. 3. Alternatively, the pod 100 may be folded into a size, appropriate for gate-checking at an airport.

The pod 100 may optionally comprise a removable top 40 (although in some embodiments the enclosure is a one-piece structure including the top, which is non-removable). For purposes of this specification "one-piece" does not necessarily mean one piece of fabric, but also includes multiple pieces of fabric connected together, for example sewn together, to form a "one-piece" enclosure. Stated otherwise, a one-piece structure can be collapsed and/or folded into its compact shape for storage without having to dissemble fabric components of the enclosure from each other.

The pod 100 may also optionally comprise windows 50, which may be opened and closed, in one or more of the panels 20 and/or the top 40. In some embodiments, the window is a hole in the panel that may be closed by attaching a cover on the window, for example using fabric. In some embodiments, as shown, the window may be a cut away of a panel 50 that rolls open and is unrolled to close. In some embodiments, the windows and/or doors are designed such that in a closed position entry of light is alleviated or eliminated. For example, the window or door cover may be cut longer and wider than the window opening to better insure a darkened interior environment. In some embodiments, the windows may be covered with a mesh fabric to reduce or prevent bugs from entering the pod 100 and/or for improved ventilation.

Figure 2:
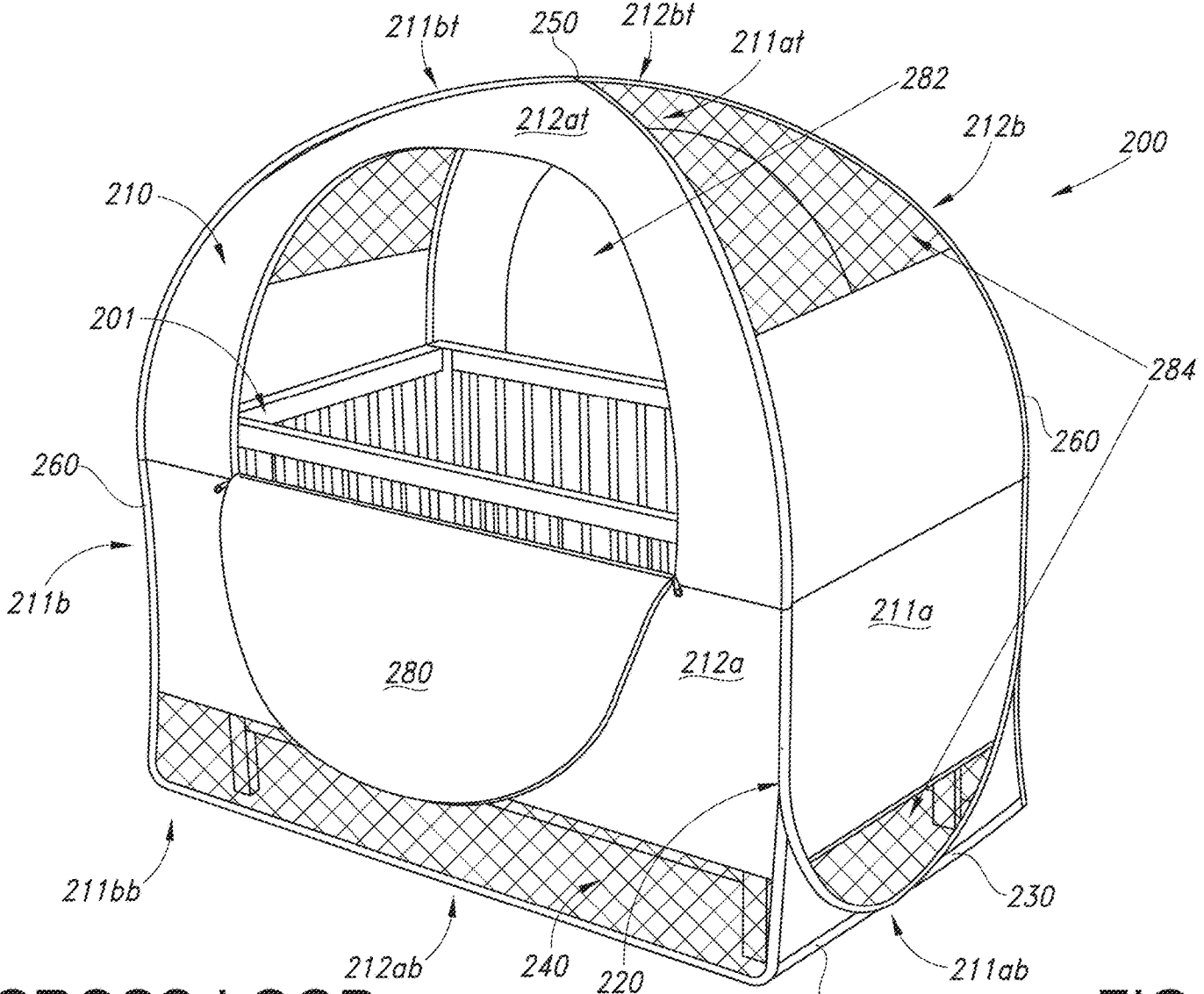
FIG. 2 is a graphical representation illustrating another example of a self-supporting, slumber pod, in accordance with various aspects of the present disclosure.

FIG. 2 is an illustration of another embodiment of a self-supporting crib enclosure/pod 200 according to this disclosure. The pod 200 is shown deployed in an open, use position enclosing a crib 201. As shown, the pod 200 can comprise a bottomless fabric enclosure 210, a flexible support frame 220, struts 230 for stabilizing the pod when in its upright position deployed over a crib, and an access door 280 large enough to load/unload a size-appropriate child into the enclosed crib through the opening 282. The opening 282 on the front arcs up and over the crib 201, allowing easy access. Vented panels 284 on the top and bottom of the pod 200 allow air to flow through the enclosure. Straight rod(s) or strut(s) 230 along the bottom of the enclosure provides stability. As shown in FIG. 3, the pod 200 is designed to collapse and fold into a compact, portable structure, which in some embodiments is small enough to meet airline carry-on limits to permit it to be carried onto an airplane, and in other embodiments is small enough to meet airline gate-check baggage requirements. The illustration of FIG. 3 is an example of what happens when the pod 200 is folded. First, the user would pull the leg(s)/rod(s) out of the plastic connector, and let them fall into a pocket. After folding up the tent, the user can push the support frame 220 and struts 230 into the center area, still within the pocket, so everything fits into the round carry bag. In the illustrated embodiment of FIG. 2, the pod 280 collapses to fit into a pouch approximately 26" in diameter and 1.5" thick. Further, in this particular embodiment, when unfolded from the collapsed position, the pod 200 automatically pops up into its open, use (tent-shaped) position shown in FIG. 2.

As shown, the fabric enclosure 210 effectively has two pairs of opposing sides 211*a*, 211*b* and 212*a*, 212*b*. The first side (211*a*, 212*a*) of an opposing pair is similar in size and shape to the second side (211*b*, 212*b*) of the opposing pair. (That is, side 211*a* is similar in size and shape to opposing side 211*b* and side 212*a* is similar in size and shape to opposing side 212*b*. Each side (211*a*, 211*b*, 212*a*, 212*b*) has a base end (211*ab*, 211*bb*, 212*ab*, 212*bb*) and a top end (211*at*, 211*bt*, 212*at*, 212*bt*) such that the joined sides (211*a*, 211*b*, 212*a*, 212*b*) form a rectangular open base 240 of a size that fits over the desired crib and a closed cover having a height that permits a size-appropriate child (as determined by the crib manufacturer), for example an age and weight appropriate child as determined by the crib manufacturer, to stand in the crib. In the embodiment illustrated in FIG. 2, the base ends 211*ab*, 211*bb*, 212*ab* (and 212*bb*, which is not shown) are wider than the top ends 211*at*, 211*bt*, 212*at*, 212*bt* such that the top ends of the side panels meet at or near an apex 250, with the height of the apex 250 being sufficient to permit a size-appropriate child to stand in the crib, at least at the apex 250. In some embodiments, when the pod 200 is configured to snugly fit over a play yard, the dimensions of the fabric enclosure can be approximately 42.5" wide by 54" tall by 5' high.

The flexible support frame 220 is configured: to keep the fabric enclosure taut when the pod 200 is in an open, use position (e.g., deployed over a crib, bed, crate, etc.); to permit folding the pod 200 into a compact size when collapsed; and, to cause the pod to pop-up automatically into a tent-shape when unfolded. The flexible frame 220 is integrated with the fabric enclosure 210. That is, the pop-up pod can be collapsed without removing the frame 220 from the fabric enclosure 210. However, in some embodiments, the frame or part of the frame 220 may optionally be removed from the fabric enclosure 210. In some embodiments, wherein the frame 220 is separable from the fabric enclosure 210, the fabric enclosure 210 may include pockets, sleeves, Velcro® loops or other structures for holding the disassembled frame 220.

Figure 4:
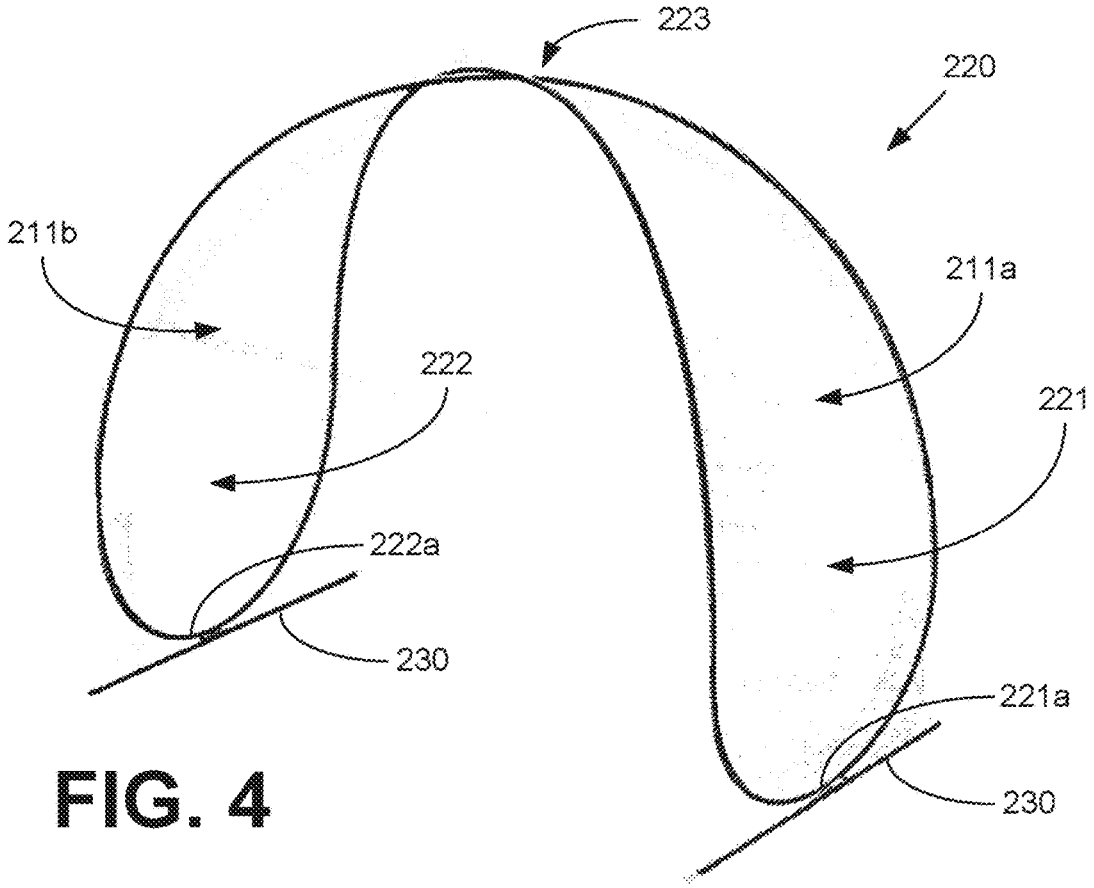
FIGS. 4 and 5 are graphical representations illustrating examples of flexible support frames for slumber pods, in accordance with various aspects of the present disclosure.

As better shown in FIG. 4, the flexible support frame 220 is shaped in a cross-loop (also referred to as a "figure eight") pattern comprising a first loop 221, a second loop 222 and a cross-over 223. The first loop 221 has a top 221*a* in a distal position relative the cross-over 223. The second loop 222 has a top 222*a* in an opposing distal position relative the cross-over 223. The cross-over 223 aligns approximately with the apex 250 of the fabric enclosure 210, whereas the top of the first loop 221*a* aligns at about the midpoint of the base 211*ab* of a first side 211*a* of the fabric enclosure 210 and the top of the second loop 222*a* aligns at about the midpoint of the base 211*bb* of a side 211*b* opposite the first side 211*a* of the fabric enclosure.

The flexible support frame 220 may be formed from one continuous piece, or it may be a plurality of pieces that seat together or are otherwise held together to form a continuous piece. The flexible support frame 220 is integrated into the fabric enclosure 210, meaning that the frame does not need to be separated from the fabric enclosure in order to collapse the pod 200 and/or fold the pod 200 into a more compact, portable shape. In some embodiments, as illustrated, the frame 220 is be located on the exterior of the pod 200 forming an exoskeleton. As shown in FIG. 2, in some cases, the exoskeleton frame 220 may be enclosed in a fabric sleeve 260 that is part of the fabric enclosure 210. The fabric sleeve 260 may be continuous (FIG. 2), or it may have openings, which enable a user to remove the frame 220 from the fabric enclosure 210, for example to replace broken parts. The integration of the frame 220 and the fabric enclosure 210 is not limited to the illustrated embodiments but can include any method known or knowable to those of skill in the art for connecting a frame to fabric. For example, the frame 200 may be hooked to the fabric enclosure 210 using clips 262*a*, 262*b*, 262*c* (see, e.g. FIG. 12E).

Figure 5:
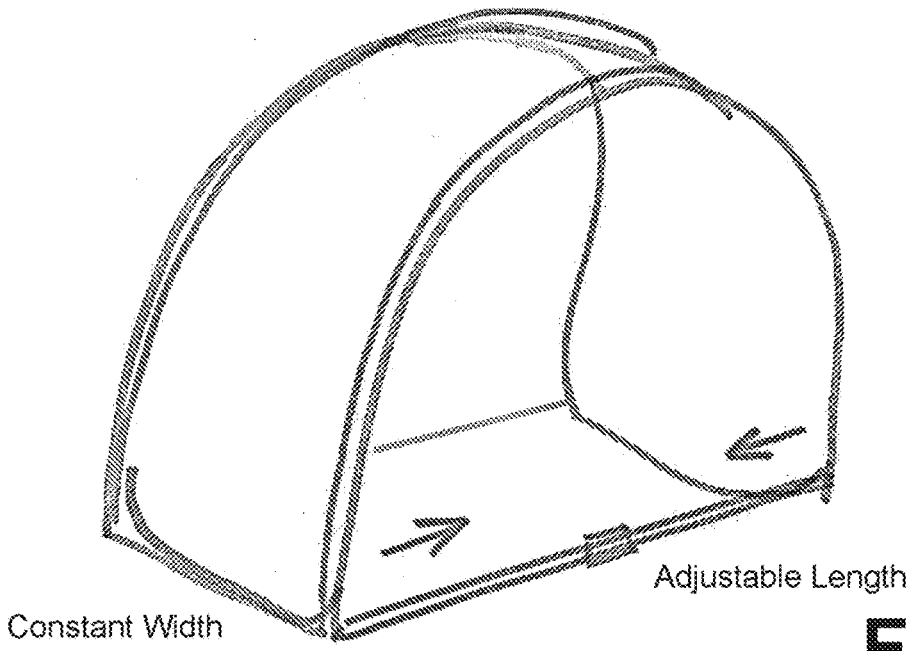
Figure 6:
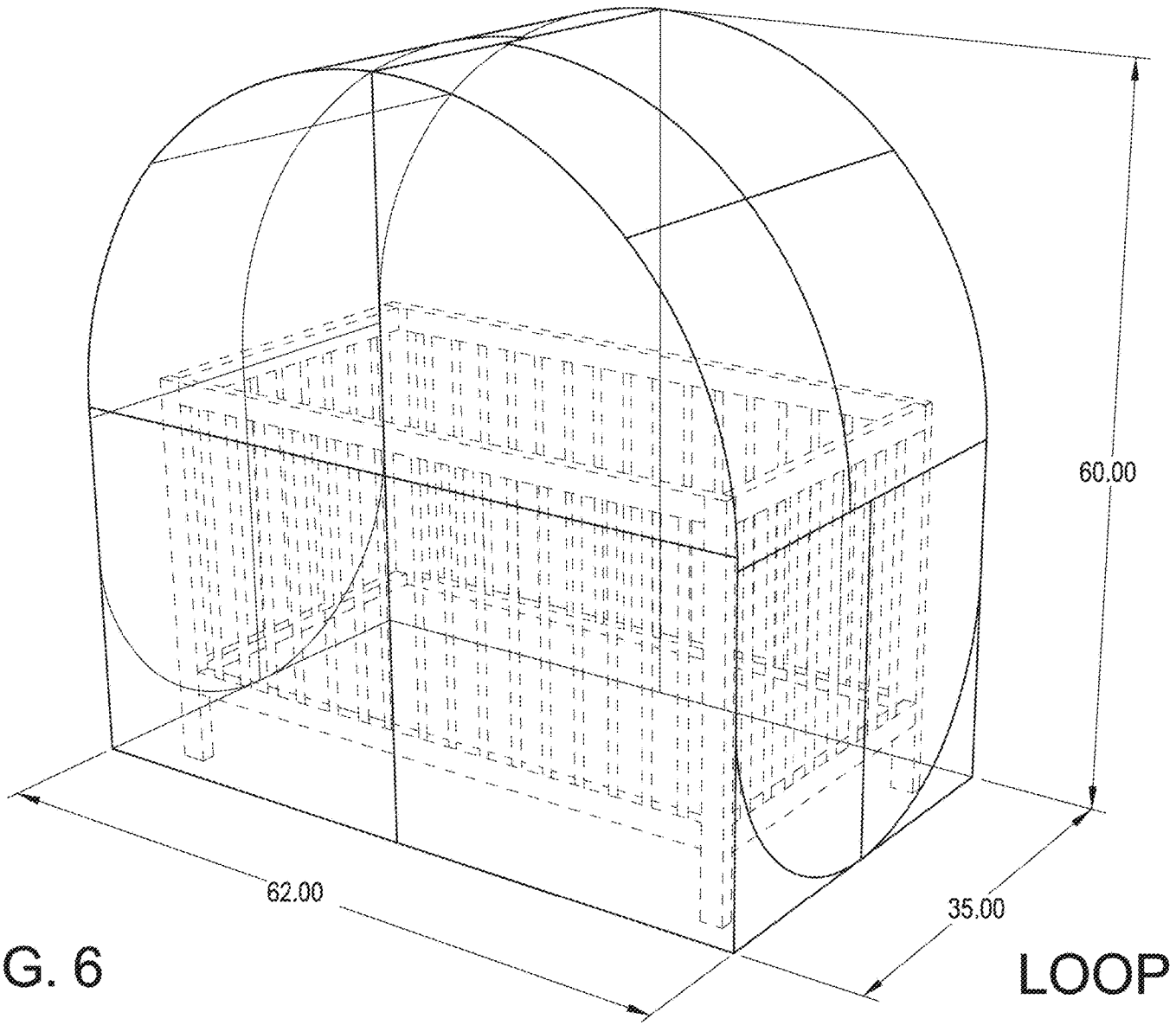
FIGS. 6-9 are graphical representations illustrating examples of slumber pod support configurations, in accordance with various aspects of the present disclosure.
Figure 7A:
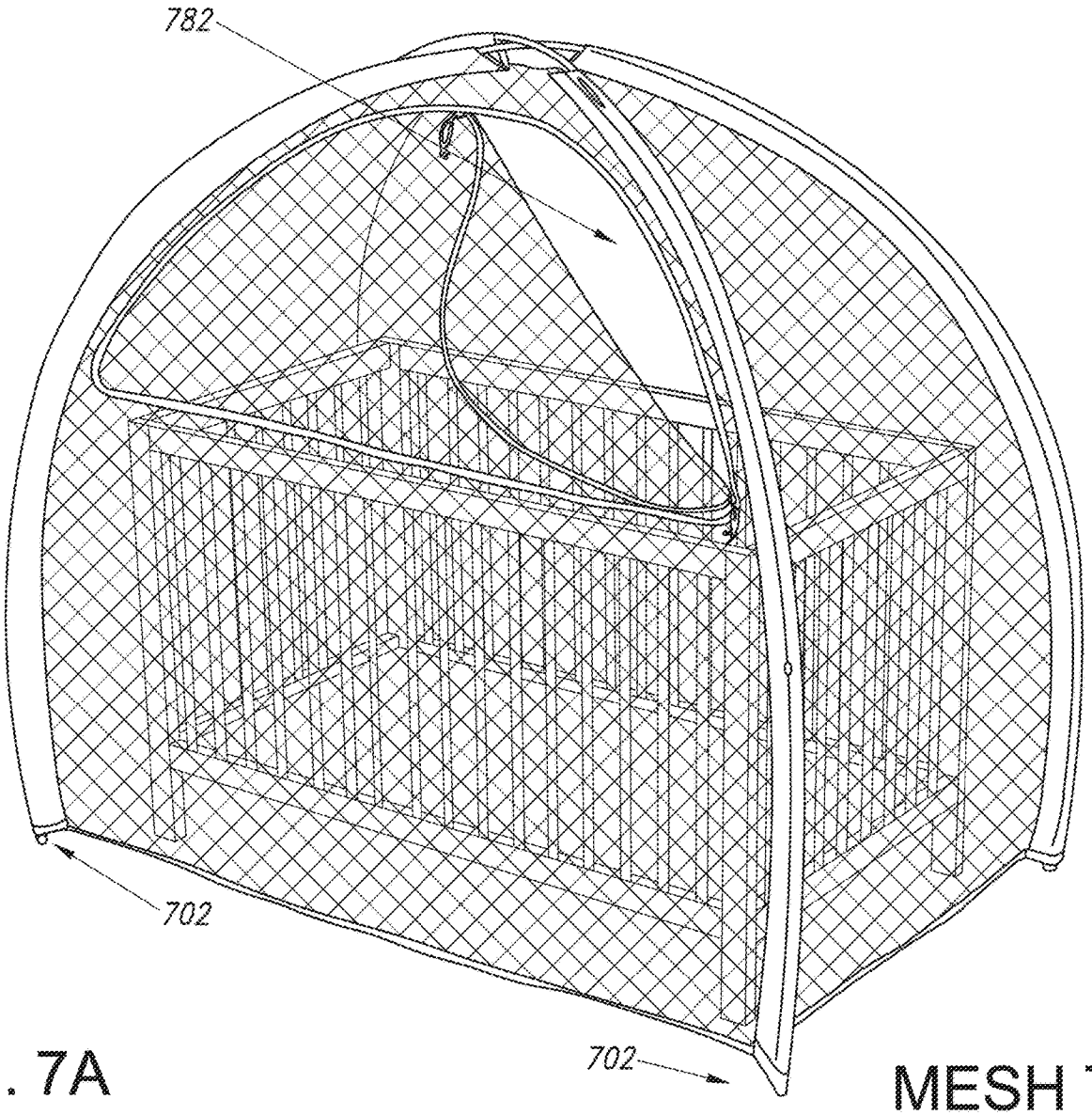
Figure 7B:
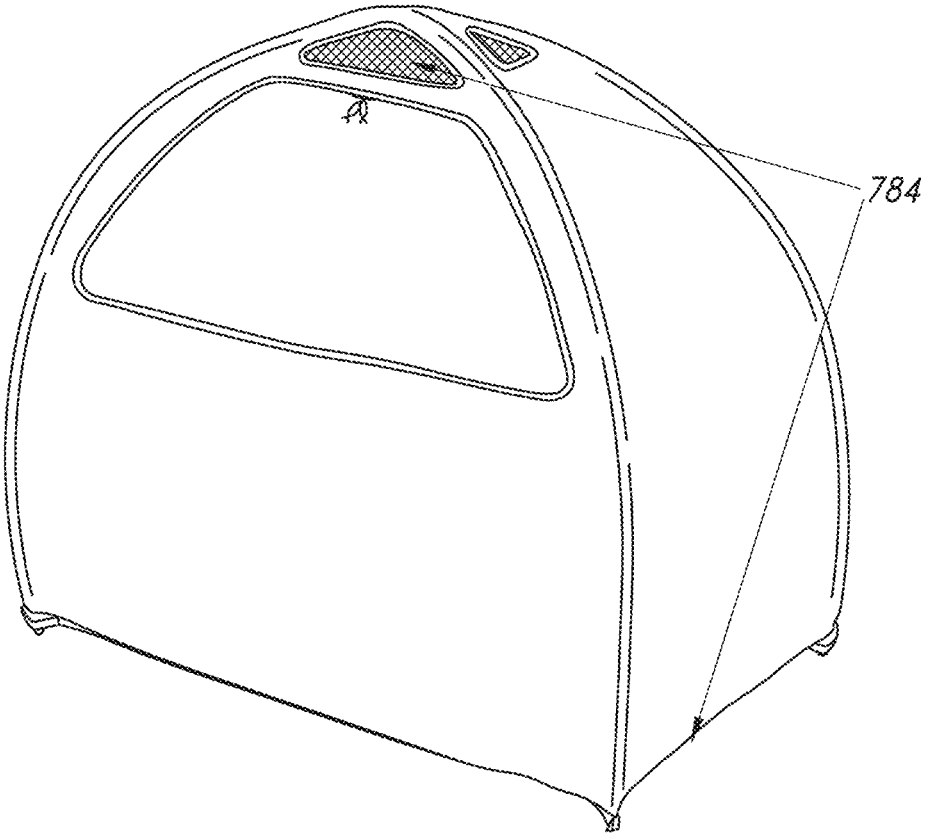
Figure 8:
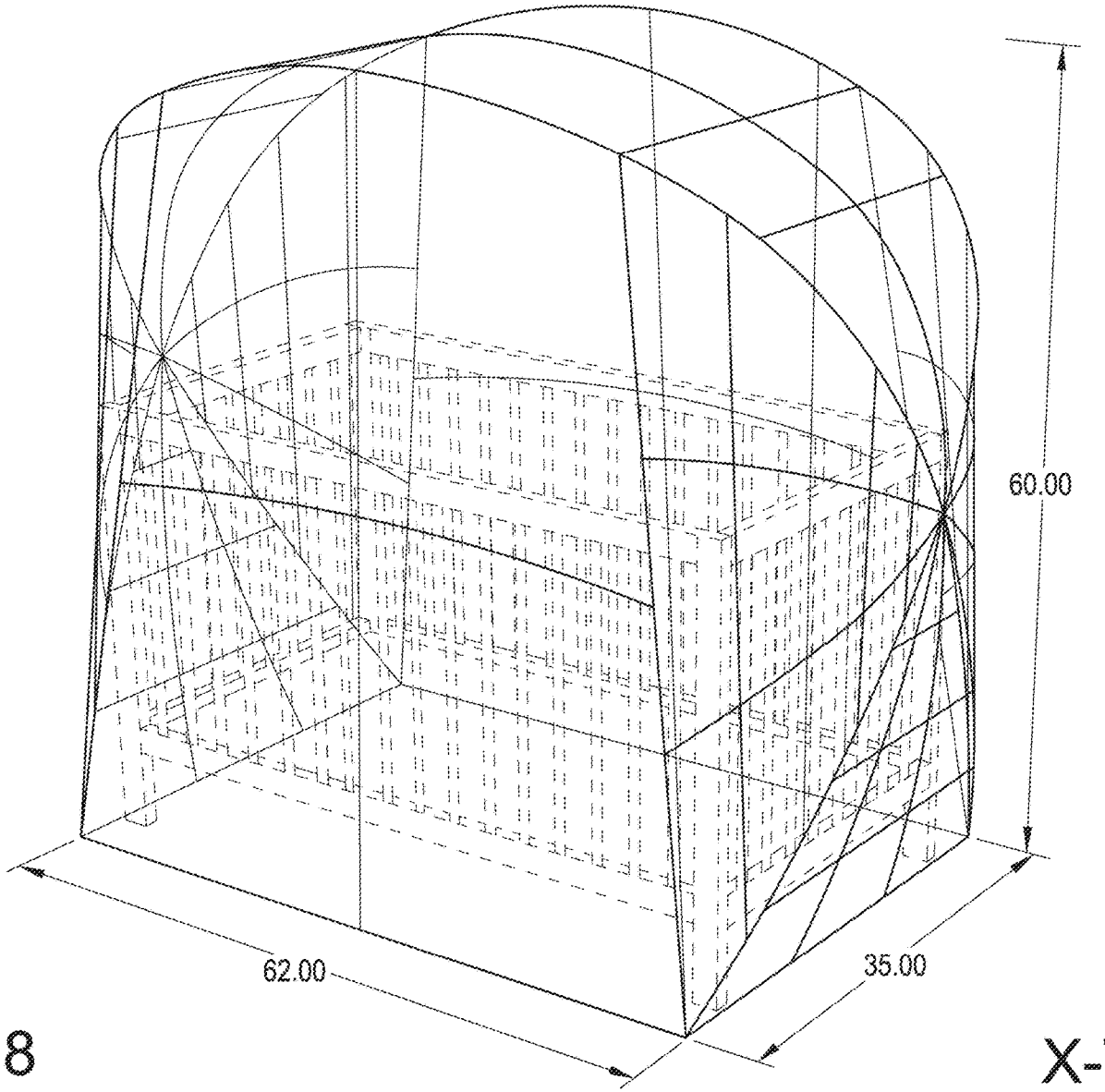

The pop-up pod 200 (and so too the support frame 220) is not limited in shape to a cross-loop, as shown in FIG. 4. For example, FIG. 5 shows a cross-loop design wherein the "loops" have flat bottoms rather than curved bottoms. FIG. 6 illustrates a "parallel loop" design in which the frame is an elongated oval that does not cross-over at the top. Advantages of the "parallel loop" design can include simple folding. The vertical door (or opening) may make it harder to load and remove a baby. Additional support may be added to on the ends to prevent roll over. FIG. 7A illustrates an "open loop" design in which the frame comprises two independent poles that cross over at the top (or apex) but are not connected at the base. A connection can be provided between legs on opposite corners. For example, the left front leg can be connected to the right rear leg and the right front leg can be connected to the left rear leg. The legs can be color coded to indicate the appropriate connections. Color coded feet 702 can connect diagonally to create loops for folding. An opening 782 on the front arcs up and over the crib, allowing easy access. A full mesh body allows air to flow through the enclosure for maximum ventilation. In this case, an opaque fly can be positioned over the frame as shown in FIG. 7B to isolate the crib. Ventilation 784 on the top and bottom of the opaque fly allows air to flow through the enclosure. An extra dark fly creates a darker, more isolated enclosure. FIG. 8 illustrates an "open loop tent" design in which the frame comprises two independent poles that cross over at the top (or apex). As in FIG. 7A, a connection can be provided between legs on opposite corners (which may be color coded). The "open loop tent" design can provide a stable structure. The vertical door (or opening) may make it harder to load and remove a baby. In some implementations, the feet may be connected to each other to fold the enclosure.

Figure 9:
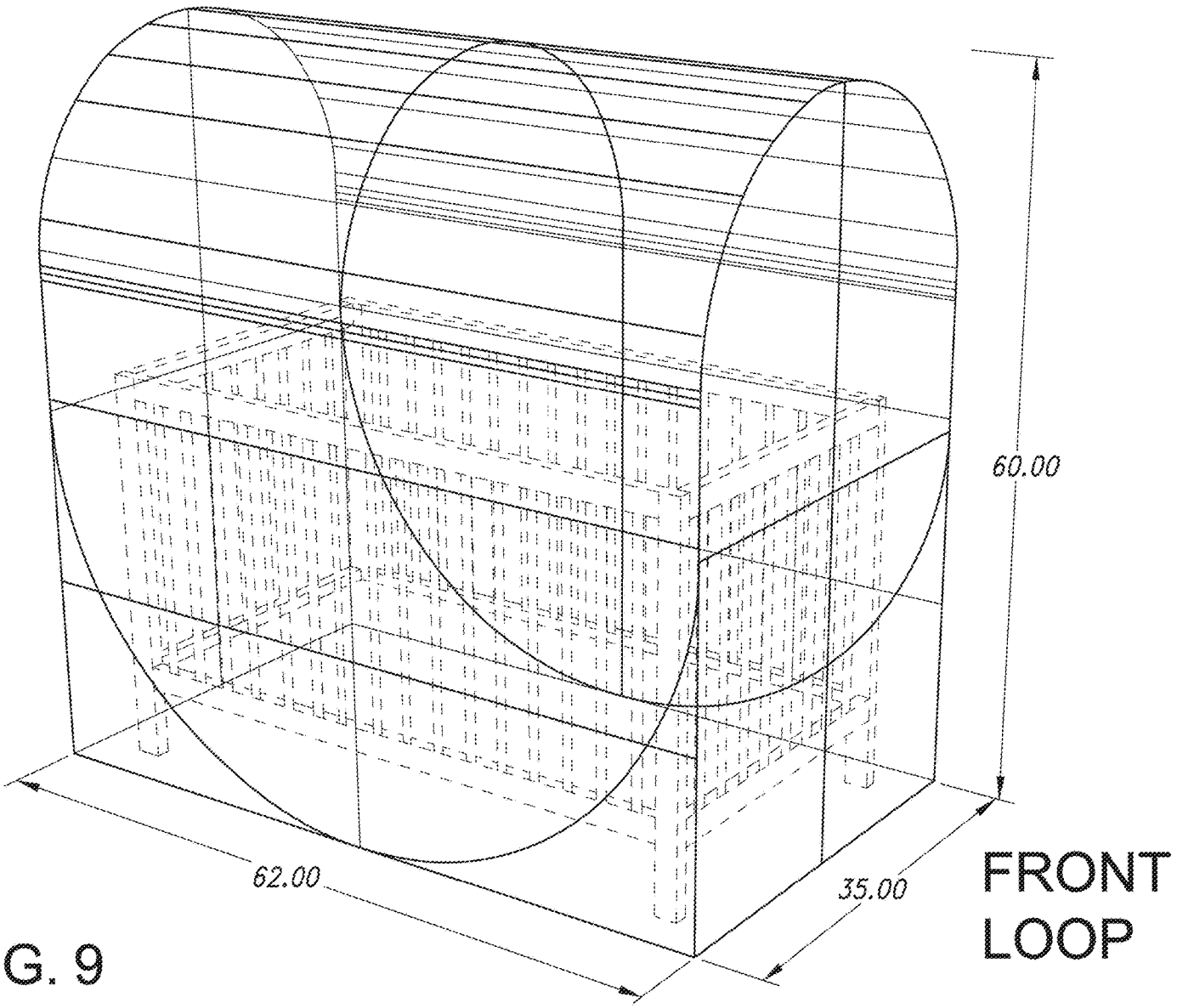
Figure 10:
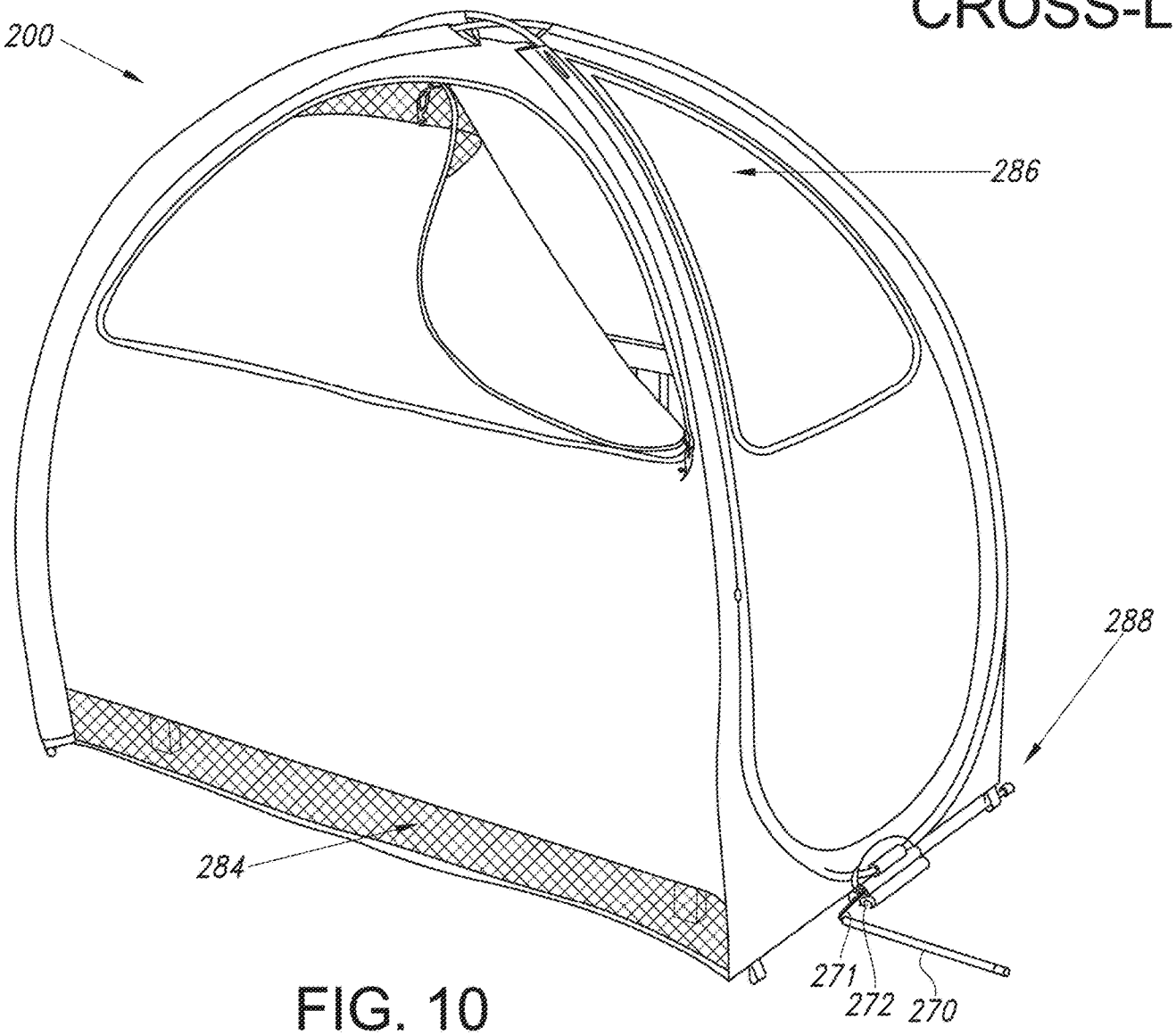
FIG. 10 is a graphical representation illustrating an example of stabilizing supports for a slumber pod, in accordance with various aspects of the present disclosure.

FIG. 9 illustrates yet another possible design shape where the cover support is provided by flexible supports that cross-over on opposite sides of the pod. Top and/or bottom support bars can be used to support the structure while standing. An arched door (or opening) can make it easier to load and remove a baby. FIG. 10 illustrates a parallel loop design similar to that of FIG. 6 except the loops are formed in the wide sides rather than narrow ends of the fabric enclosure. Alternatively, the pod 200 may also be shaped similar to a conventional X-frame tent (but the pod 200 would be bottomless). In such an X-frame embodiment, opposite corners of the X could hook up, forming two loops that can be condensed. In each of the illustrated embodiments, the pod 200 comprises a fabric enclosure with an integrated frame that: keeps the fabric enclosure taught when in the open, use position; permits the pod to collapse without having to remove the frame and fold down onto itself into a more compact, portable shape; and may also enable the pod to automatically pop up into the open use position when unfolded. Vented panels 284 on the top and/or bottom of the pod 200 (e.g., below the crib or pack-n-play level) can allow air to flow through the enclosure. Straight rod(s) or strut(s) 230 along the bottom of the enclosure provides stability.

Although the illustrated embodiments are configured to fit snugly over the desired crib (for example with limited space between the crib and the pod), as discussed previously, the pod 200 may be configured as a one-size-fits all solution. For example, the dimensions of the pod 200 may be configured such that the pod fits over cribs of various sizes. Alternatively, the frame 220 may be constructed to expand or retract to fit various crib sizes, as illustrated in the example of FIG. 5. Similarly the fabric enclosure 210 may comprise a stretchy fabric to accommodate the frame as it expands, or as another example, the fabric enclosure may be zippered or unzippered to release or gather extra fabric enabling the enclosure to expand and contract. Stretch panel(s) 286, made of Lycra® or other appropriate material, can be provided so that the poles can spread and make the circular form when folded and/or twisted.

The pod 200 may optionally include one or more struts for stabilizing the pod 200 in order to prevent or limit the pod 200 from tipping over when in use (e.g., in order to limit front to back rocking). There are many possible implementations of stability struts. In one embodiment, illustrated in FIGS. 2 and 10, the pod can include two stabilizing struts 270, one at the base of each loop extending the width of the fabric side enclosing the loop. The loop can be a continuous rod, crossed at the top, and enclosed in a sleeve. In some embodiments, interlocking rods held together by a bungie cord (e.g., shock cord poles) can be used. As best shown in FIG. 10, each stabilizing strut 270 may be formed from more than one support rod threaded together by a bungie cord 271. In one embodiment, the stabilizing struts 270 slide through a central channel 272 located at the base of each loop of the support frame and may also slide into fabric loops at the base of the pod 270 for additional alignment. The sleeve can be sewn to form corner loops or pockets 288 at the bottom of the pod 200, even though the rod may be making a loop. Straight rod(s) or strut(s) along the bottom of the enclosure provides stability. They can be interlocking rods (e.g., shock cord poles) threaded with a bungie to hold them in place, and can slide into a central sleeve when folded. When the pod 200 is folded, the rods 270 (or shock cord poles) can be pulled apart (though still held together by the bungie cord 271) and stored by snapping them into c-channels connected to the pod 200.

It may also be possible to implement the pod 200 in a "pup tent" design with a triangular cross-section. It this case, front and back sides can taper upward to a ridge along the top of the pod. One or both of the sides can include a zippered opening to access the crib. Right and left sides can extend upward substantially perpendicular to the ground, or can taper inward similar to the front and back sides. Support can be provided by poles that extend from the corners to the ends of a ridge pole.

Figure 11A:
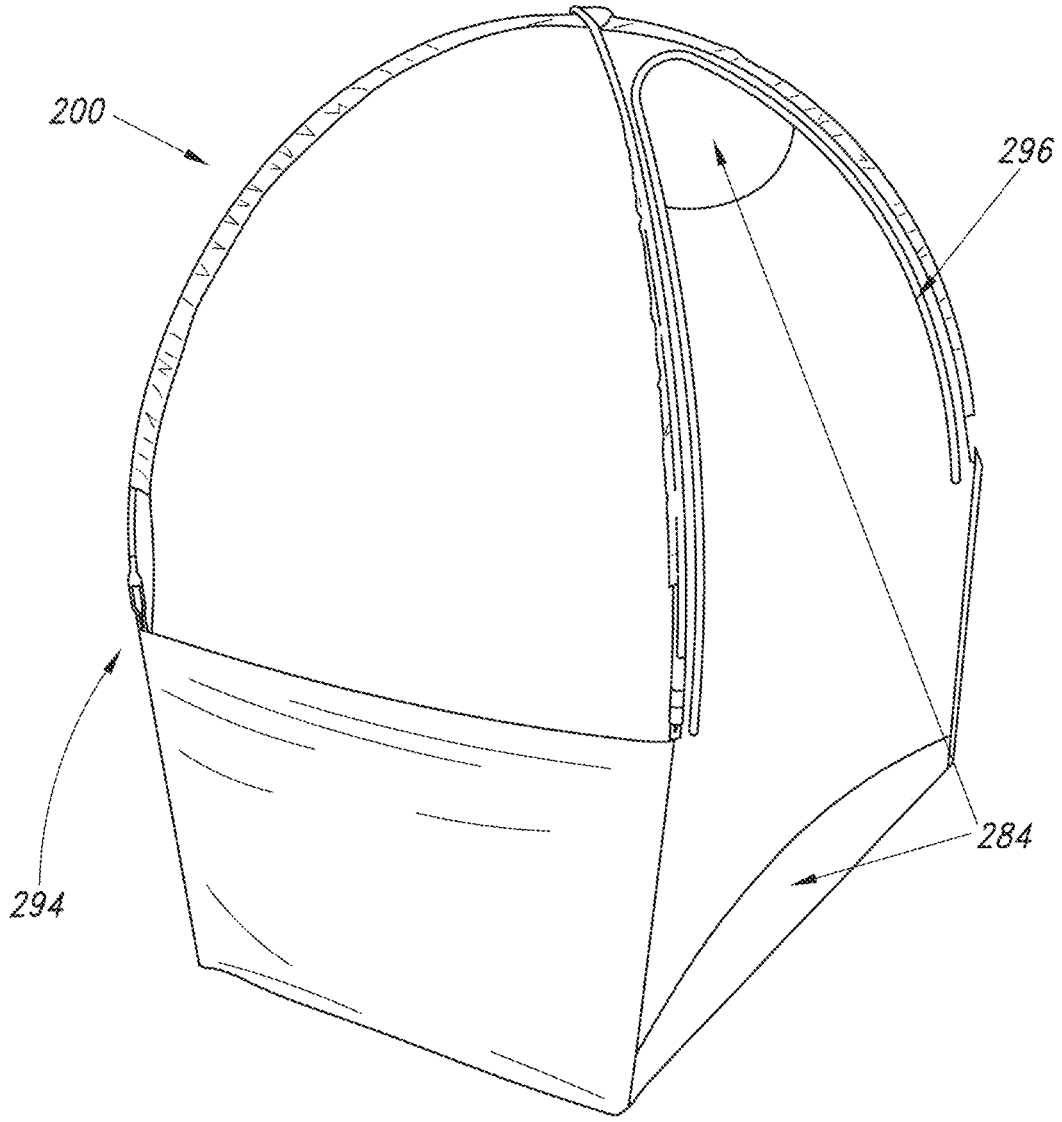
FIGS. 11A-11C are graphical representations illustrating an example of the deployment of support legs for a slumber pod, in accordance with various aspects of the present disclosure.
Figure 11B:
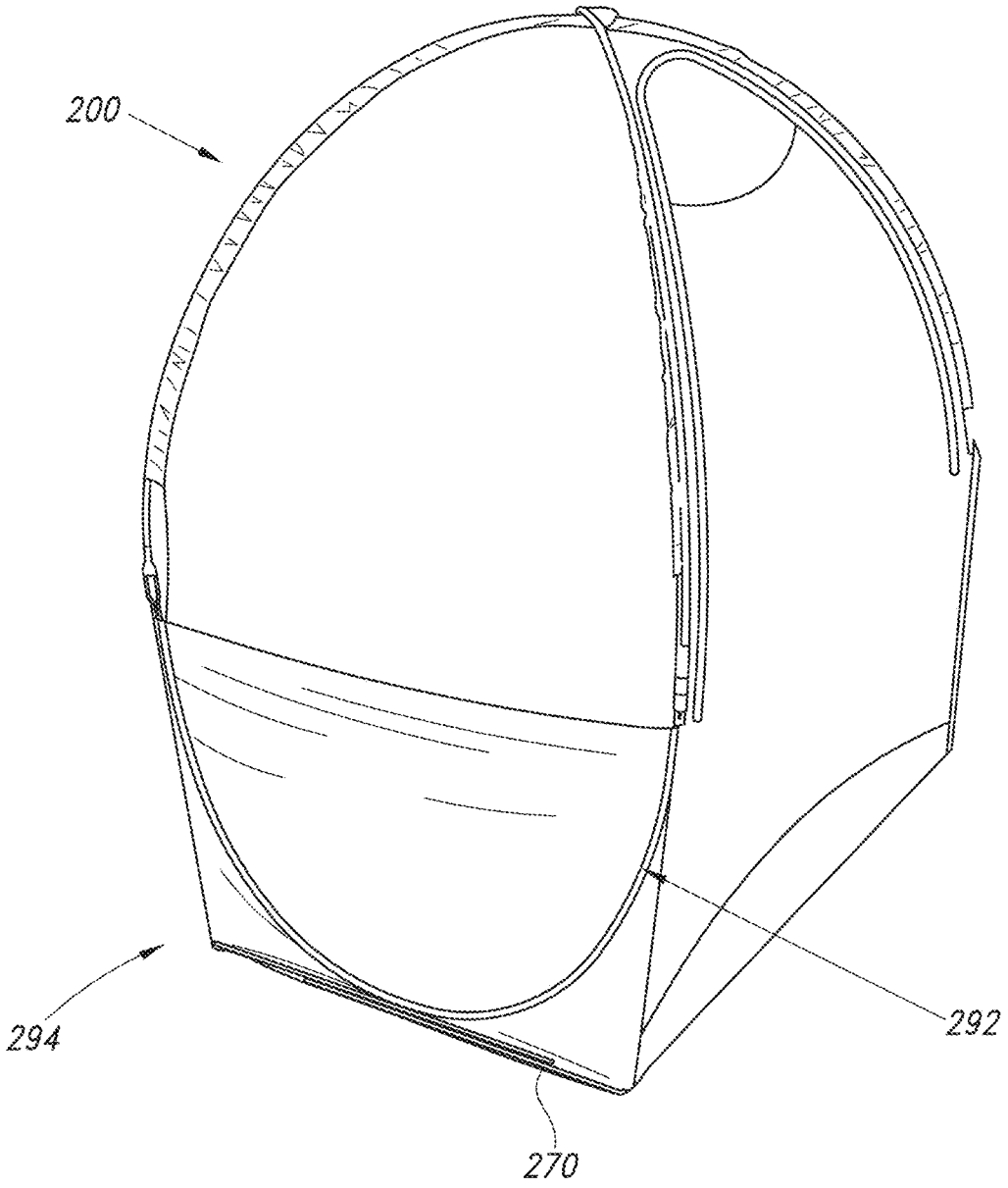
Figure 11C:
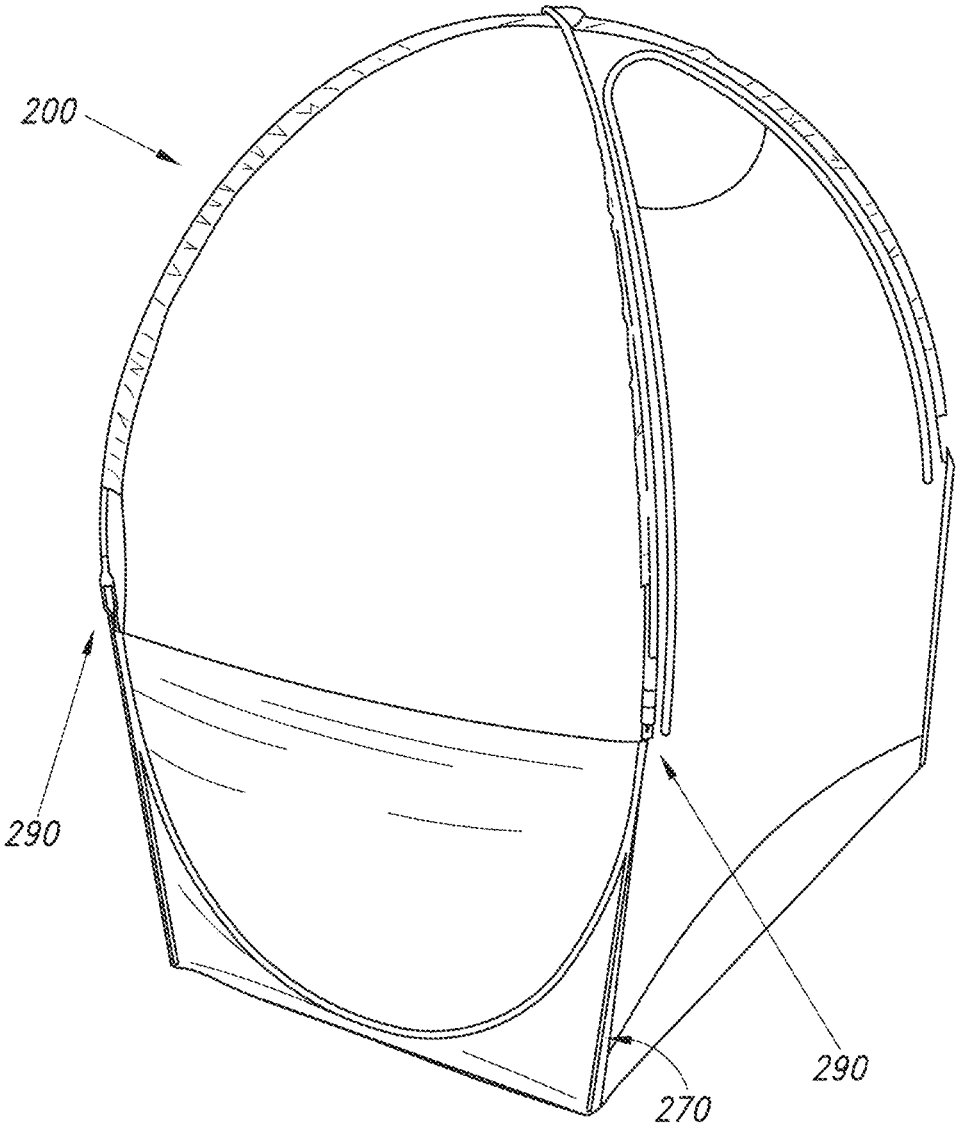

In another embodiment, illustrated in FIGS. 11A-11C, the struts 270 comprise four stability legs 270, one positioned at each corner of the base of the pod 200. As best shown in FIG. 11C, when in use, each stability leg extends along one of the four bottom edges of the pod 200. In some embodiments, each stability leg 270 (as in the embodiment of FIGS. 11A-11C) extends from the base of the pod 200 to a location partway up a side of the pod. In other embodiments, one or more stability legs 270 may extend partway along each bottom edge of the pod 200 but not necessarily from the base of the pod 200. The stability legs 270 may be removeable, may be fixed, or as is illustrated in FIGS. 11B and 11C, may be retractable. For example, a retractable stability leg 270 may be removeably connected to the frame 220 to facilitate collapsing and folding of the pod 200 for storage. To keep the pod 200 from rolling, the user can rotate each leg up into a vertical position and slip the free end of the rod 270 into a receptacle (e.g., a hole) in a plastic connector 290. The rod 270 may be held in position in multiple ways. For example, a plastic connector 290 on the frame loop 292 with a hole that the rod 270 is inserted into can be used. Other types of connections and/or fasteners may be used to hold the leg in position. The end of the stability leg 270 proximal to the base may be loose or it may be attached to the fabric enclosure in a manner that allows the stability leg 270 to rotate into the upright position from the collapsed position (shown in FIG. 11B) or expand into the upright position (not shown). The rod 270 can be sewn to the pod 200 at the bottom corner.

In some embodiments, the pod includes a mechanism to store the stability legs for efficient transportation. For example, the stability legs may be removed and placed in a pouch that also holds the collapsed and folded pod. As another example, the stability legs may retract into a sleeve or pocket integral with the fabric enclosure as shown in FIGS. 11A and 11B. The deep, oversized pocket 294 can be added as a way to hide the loop 292 of the frame, and can store the collapsed legs. FIG. 11B shows two legs or rods 270 in the bottom of the pocket 294, and the frame loop 292 extending across the pocket 294 with the cross-loop construction. One end of each rod 270 can be connected (e.g., sewn) to an outside corner of the pod 200, while the other end is free to move. In this "stored" position, the rods 270 do not stabilize the pod 200 allowing it to roll over. The fabric enclosure (or pocket) embodiment of FIGS. 11A-11C is approximately 24" deep. As yet another non-limiting example, the stability legs 270 may be removed or retracted and attached by Velcro® to the fabric enclosure. In other implementations, the pocket 294 may not be included. The loop 292 of the frame can be enclosed in a semicircular sleeve (e.g., about 2 inches wide) that can be sewn to the surface of the pod 200. In this case, the legs or rods 270 can still be sewn at the outside corners of the pod 200, but can held in position when the pod 200 is folded up using, e.g., Velcro loops, ties or other attachments.

As shown in FIG. 11A, an arched door (or opening) can be provided to load and remove a baby. The door or opening can be secured using, e.g., a zipper 296, which can include two pulls to allow opening in either direction and stops that can be located about 24 inches above the ground. Vented panels 284 on the top and/or bottom of the pod 200 can allow air to flow through the enclosure. As the warm air rises and leaves through the top vent panel 284, fresh air is pulled into the pod 200 through the bottom vent panel 284. Both sides of the pod 200 can have top and bottom vents 284. The top vent panel(s) 284 can be covered with a small flap of fabric to keep light out. The flap can be opened as needed to aid in ventilation. The bottom vent 284 should not extend above the bottom of the crib or pack-n-play.

Although FIGS. 2 and 10-11C illustrate two implementations of stability struts, stability struts are not limited to these examples but include any possible mechanism for reducing or eliminating tip over. For example, the stability legs could be similar to those illustrated in FIGS. 11A-11C but attached to the pod higher up on the leg with a "swivel-lock" that spins the leg inside the loop to outside the loop providing the strut/buttress function. Alternatively the strut may be two angled components that mount to the loop at specific locations and flip inside-to-outside to from a strut that prevents tipping. In other embodiments, the strut could be in the form of a larger outrigger that extends outside the fabric enclosure to provide a wider base. In yet other embodiments the strut may be in the form of a plastic base that extends the full width of the loop and has an integrated handle.

Referring back to FIG. 2, the pod 200 also includes an access door 280. The access door 280 should be sized large enough to permit loading/unloading of a baby or toddler (up to a size specified by the crib manufacturer) into the crib 201 when it is enclosed by the pod 280. Similarly, the access door 280 can be located in the fabric enclosure 210 at a position, which facilitates easy loading/unloading of the baby/toddler without also compromising or significantly compromising the stability of the pod 200. For example, in embodiments, the access door 280 does not completely unzip through the bottom of the fabric panel in which it is positioned so that it cuts entirely through resulting in the pod 210 splaying open. Similar to the panel 50 described in connection with the embodiment of FIG. 1, the access door 280 may be a hole in the panel that may be closed by attaching a cover on the door, for example using fabric. Or, the access door 280 may be a cut away of a panel that rolls open and is unrolled to close. Or, among other possibilities, as shown, the access door 280 may be a cut away panel that unzips to open, and zips to close. In some embodiments, door is designed such that in a closed position entry of light is alleviated or eliminated. For example, the door cover may be cut longer and wider than the window opening to better insure a darkened interior environment. In some embodiments, the door may also include a mesh fabric liner, which may be opened and closed independently of the light-darkening fabric door cover. That is the fabric door panel may be opened and the mesh cover left closed for example to prevent or limit entry of bugs or insects. Or the fabric door panel may be opened and the mesh panel may be opened to permit loading/unloading of the baby/toddler.

The various pod embodiments may include optional windows and optional pockets or other structures for holding/attaching accessories (interior and/or exterior). For example, the pod may include a pocket for holding, or other component for securing, a baby monitor in the pod. In some embodiments, the pocket is therefore sized to be about 9"×6.5" to hold currently available baby monitors. The pocket or other securing component may be located within the pod so that parents may monitor their baby's well-being. Or it may be located outside the pod and if intended to hold a baby-monitor, the interior portion of the pocket may be a clear material providing visual access for the monitor and the exterior of the pocket may be of a light limiting material to reduce the amount of light entering the pod.

And, as shown for example in FIG. 2, the pod 200 may include vented panels for improved air circulation. For example, a mesh panel can be located toward the bottom of the pod and also toward the top of the pod to create a "chimney effect" for circulating air. The vented portions may be, for example, a mesh fabric. The vented portions may optionally include a cover, made for example of light darkening fabric wherein the cover can be opened to expose the mesh and facilitate circulation or the cover may be closed to limit light entry into the pod.

Also, the fabric portion of the various pod embodiments described herein may be made of a breathable, performance fabric. In some embodiments, the fabric is also a room-darkening material to limit the entry of light from outside the pod into the pod. Accessory pockets may be made of rip stop nylon as an example. The integrated frame may be piping for example in the form of a spring-back wire (or flat wire) made of, e.g., 302/304 stainless steel of 0.102" diameter, 1 lb coil, or alternatively the piping may be made from fiberglass. The fabrics and materials aren't limited to the specific materials identified. Rather, a person of skill, based on reading this disclosure, should be able to choose appropriate materials to build a product according to this disclosure.

In use, the pod is unfolded from its collapsed position, and in some embodiments automatically "pops up" into its use position when unfolding is initiated. The pod is lifted over the crib, positioned to enclose the crib and rest on the ground. The access panel, whether the door or roof, is opened so that a baby/toddler may be loaded into the crib. The access panel may then be closed to isolate the baby/toddler from the room in which the crib is located.

Figure 12A:
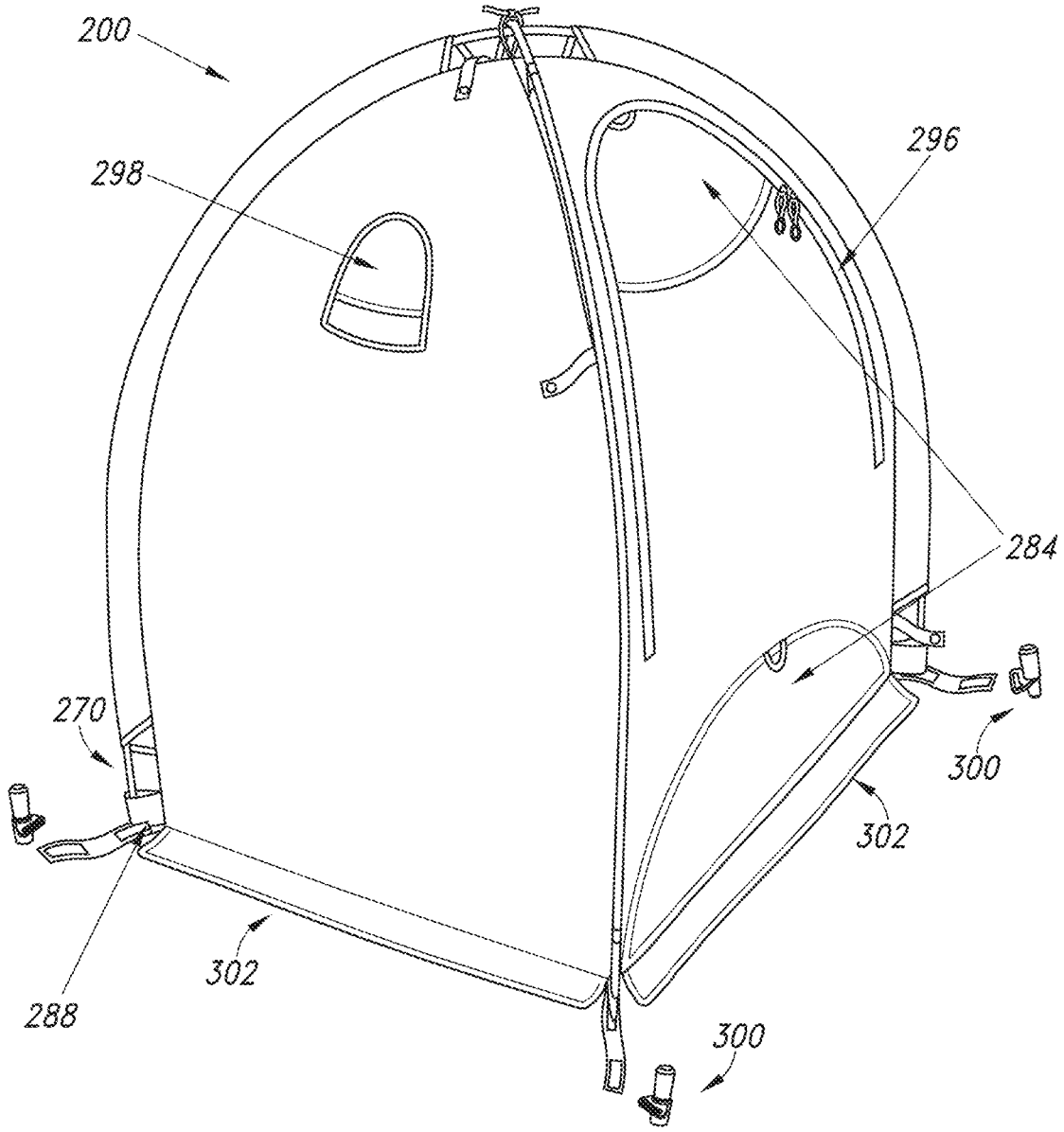
FIGS. 12A-12D are graphical representations illustrating an example of a slumber pod and its storage, in accordance with various aspects of the present disclosure.

Referring next to FIG. 12A, shown in another example of a pod 200 for over a crib. The body can be made with light blocking material such as, e.g., 90% polyester and 10% Lycra®, or other appropriate material. A camera pocket 298 with a slit to insert a camera can be included on one side of the pod 200. The inside surface of the pocket 298 can comprise a clear vinyl surface to provide visibility of the infant in the pod 200. In the example of FIG. 12A, the rods or poles 270 extend from opposite corners and cross at the top of the pod 200. The poles 270 can be fiberglass, spring-back wire, or interlocking poles secured together by a bungie cord (e.g., shock cord poles). The poles 270 can pass through sleeves (e.g., taffeta with a double seam) that extend along the four corners of the pod 200. The ends of the poles 270 can be inserted into pole pockets 288 (e.g., snap straps or webbing loops or pockets) at the bottom corners of the pod 200. In other embodiments, the ends of the poles 270 can be inserted into pole connectors 300 that can be secured at the corners using, e.g., Velcro® straps that fit through slots in the pole connector 300. Ties and/or snap straps can be provided at the top of the pod 200 to secure the body to the poles 270.

An arched door (or opening) to load and remove a baby can be secured using, e.g., a zipper 296, which can include two pulls to allow opening in either direction. Vented panels 284 on the top and/or bottom of the pod 200 can allow air to flow through the enclosure. In the example of FIG. 12A, a top vent 284 is incorporated in the arched door. As the warm air rises and leaves through the top vent panel 284, fresh air is pulled into the pod 200 through the bottom vent panel 284. Both sides of the pod 200 can have top and bottom vents 284. The top vent panel(s) 284 can be covered with a small flap of fabric to keep light out. The flap can be opened as needed to aid in ventilation. The pod 200 can be provided without a bottom surface to fit over a crib, but can include side panels 302 that extend outward onto the floor to block light from entering the pod 200.

Figure 12B:
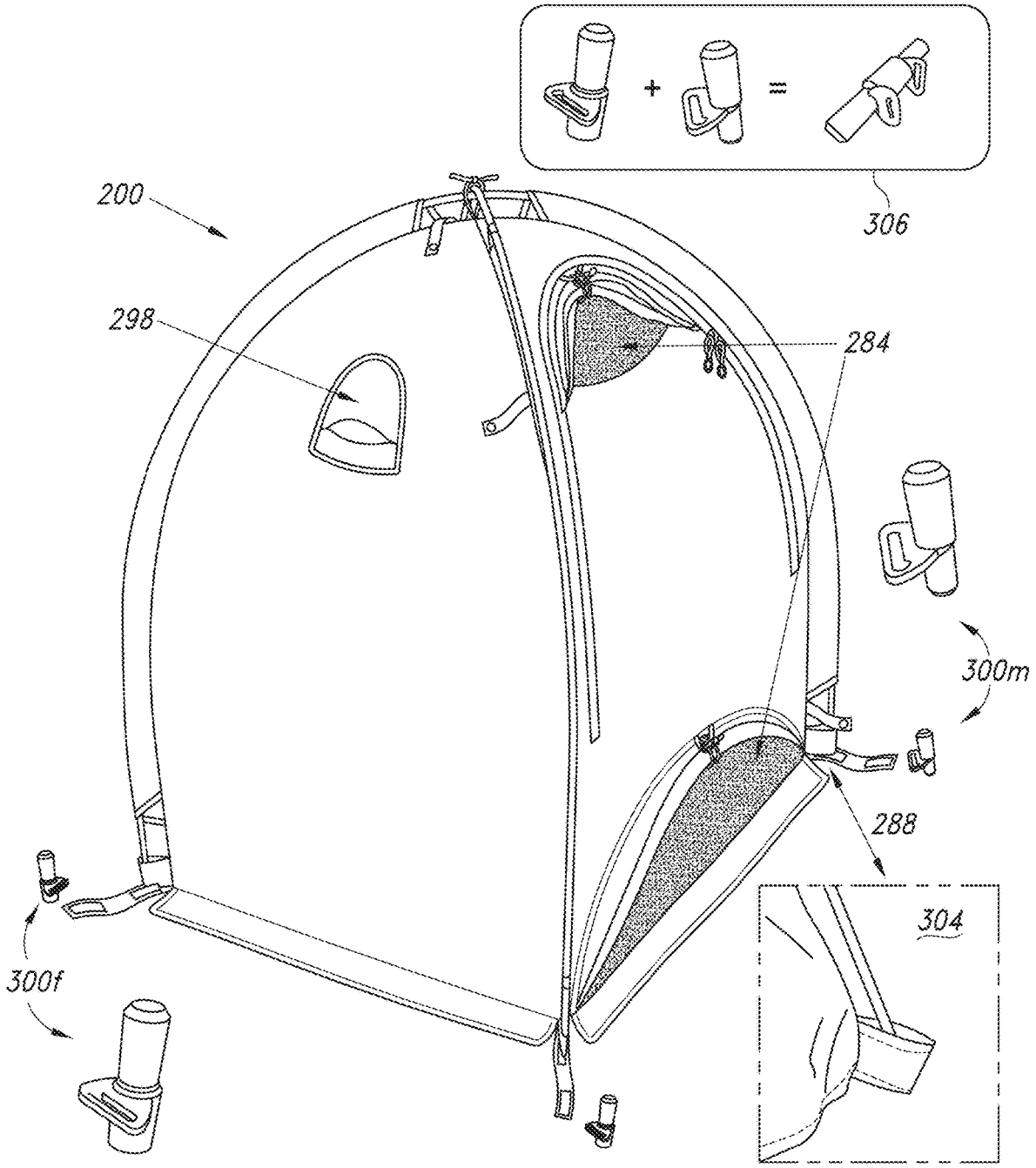

In FIG. 12B, flaps on the vented panels 284 are shown pulled open exposing a mesh screen. The flaps can include an elastic tie on the inside and a loop on the outside to allow it to be held open. An overlapping slit in the camera pocket 298 can be located near the bottom to allow a camera, smart phone or other imaging device to be inserted inside. Insert 304 is an image illustrating an example of a pole pocket 288 made with webbing. In addition, the pole connectors 300 can include male connectors 300*m* and female connectors 300*f* that can be inserted on opposites ends of a pole 270. This allows the two ends of the pole 270 to be connected together as illustrated in insert 306. Dimensions of the pod 200 can vary. In one example, among others, the base of the pod 200 has an interior width of about 34 inches and an interior length of about 48 inches. The poles 270 can have a length of about 128 inches, which can provide a total height of the pod 200 (at the apex of the poles) of about 50 inches. The body of the pod 200 can be fabricated so that the width and length remain constant to the bottom of the door or opening, which can be about 24 inches from the bottom of the pod 200. The pole sleeves and pole pockets can be about 2.5 inches wide to allow the insertion of the poles 270. The Velcro® straps for the pole connectors 300 can be about 7 inches long and about one inch wide, and the snap straps can be about 4 inches long and about one inch wide. Other dimensions can be utilized for the pod 200.

Figure 12C:
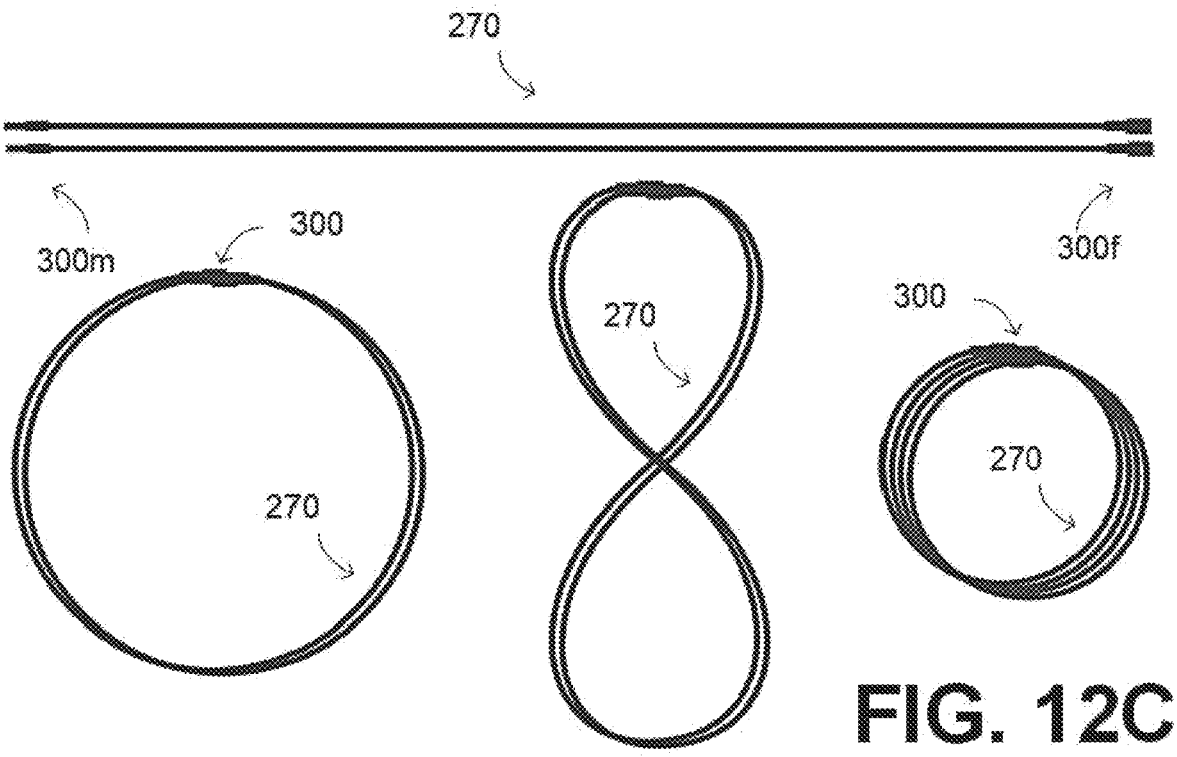
Figure 12D:
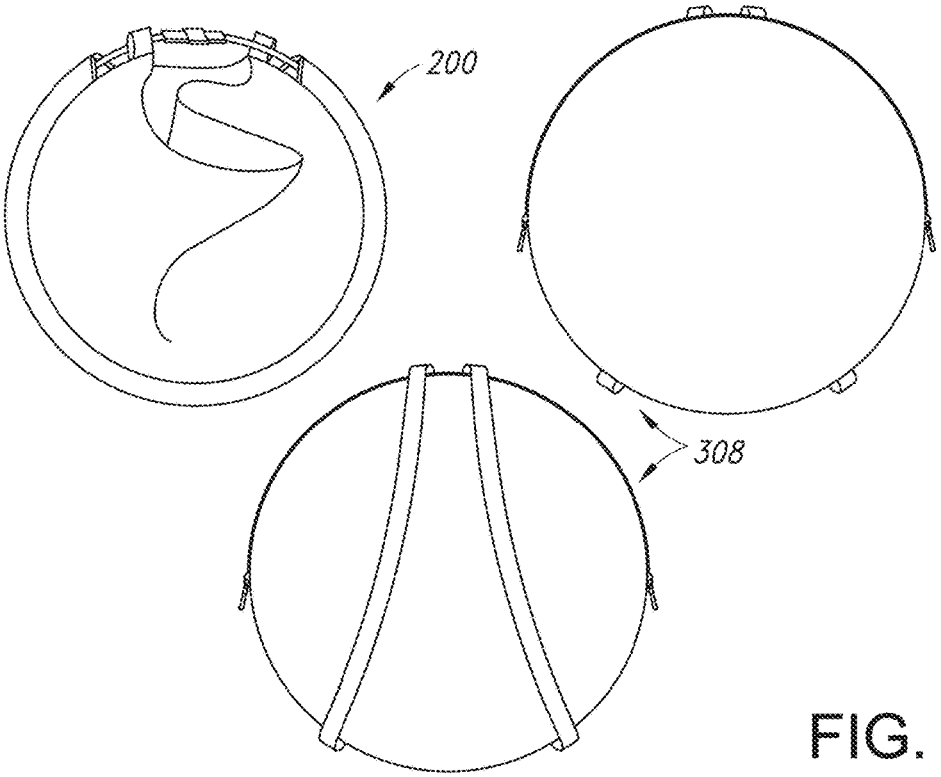
Figure 12E:
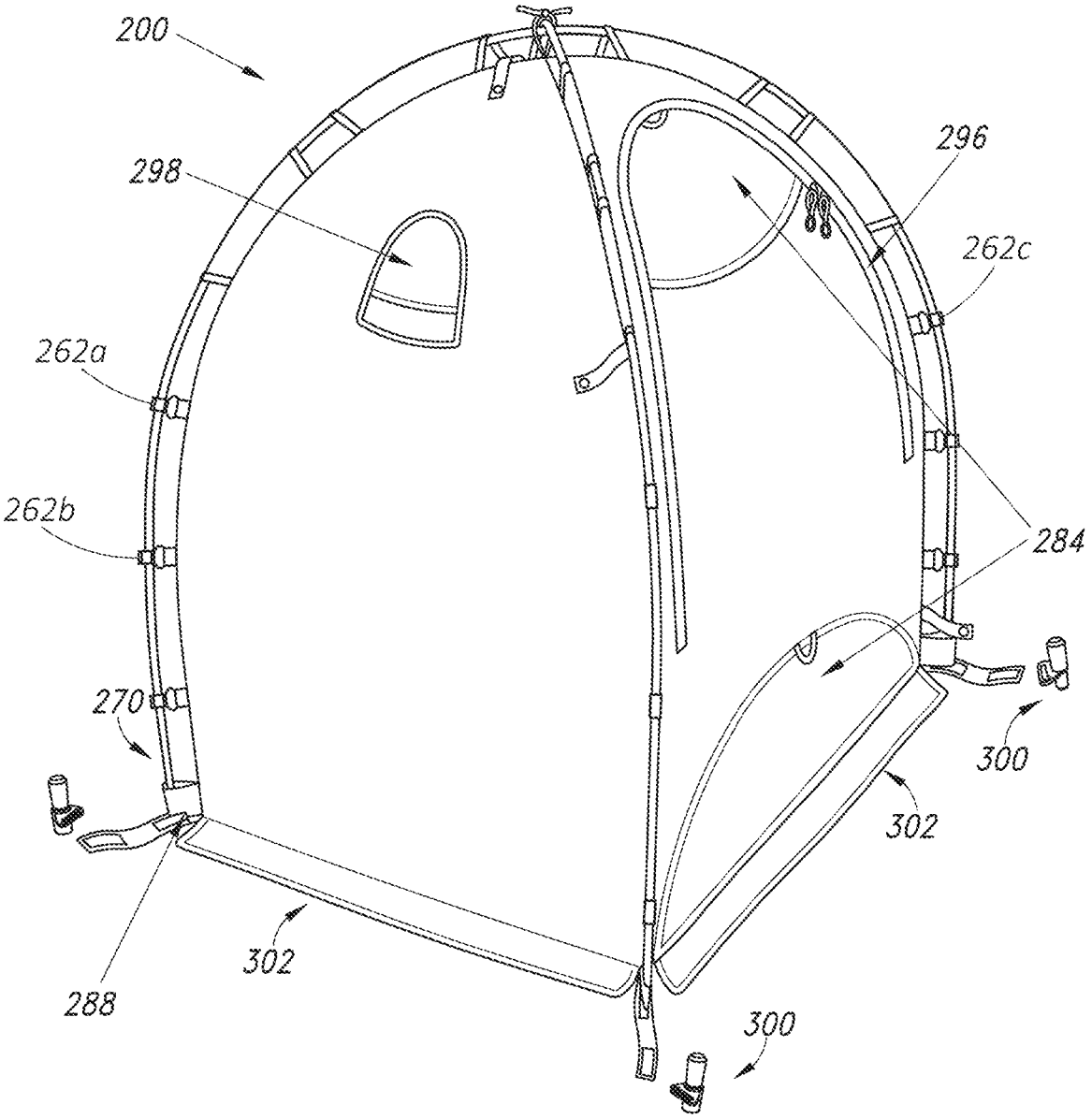
FIG. 12E is a graphical representation of an example of a slumber pod as depicted in FIG. 12A, however including clips in place of a portion of the sleeves that receive the frame.

FIG. 12C illustrates an example of the rods or poles 270 with the male and female pole connectors attached. The poles 270 can be bent to secure the ends together using the pole connectors 300. The poles 270 can then be twisted and folded to reduce their size for insertion into a bag or other container. FIG. 12D shows an example of the pod 200 (including poles 270) folded into a compact, portable structure with a diameter of about 20-21 inches, which can then be inserted into a carrying bag 308. The bag 308 can include a zipper to close the bag and shoulder straps for transport. In some embodiments, interlocking rods held together by a bungie cord (e.g., shock cord poles) can be used. The interlocking rods can be hollow with a bungie cord threaded through the center to hold them in place (e.g., shock cord poles). Ends of the rods can be coupled together to form a continuous rod encasing the bungie cord, and can be disassembled by uncoupling the ends of the rods, allowing it to be folded for storage. When these rods are used, the pod 200 can be folded into a different shape (e.g., wrapped around the folded rods in a cylindrical shape) and stored in a carrying bag with a different configuration than the carrying bag 308 illustrated in FIG. 12D. For example, a cylindrical or rectangular may be used.

Although example embodiments have been described herein, those skilled in the art will appreciate that modifications are possible in the example embodiments without departing from the broad inventive concepts. For example, the pod may be modified to enclose an adult bed, such as a twin bed, full bed, queen bed or king bed. The embodiments may also be varied to fit over pet crates, carriers or cages, or other bedding arrangements as can be appreciated. Examples of additional non-limiting embodiments are provided below in the "Additional Embodiments" section. It is understood therefore that this disclosure and the inventive concepts are not limited to the particular embodiments disclosed, but are intended to cover modifications within the spirit and scope of the inventive concepts including as defined in the appended embodiments. Accordingly, the foregoing description of various embodiments does not necessarily imply exclusion. For example "some" embodiments or "other" embodiments may include all or part of "some", "other", "further" and "certain" embodiments within the scope of this invention.

Additional Embodiments

1. A crib accessory, comprising: a bottomless, self-supporting, portable, collapsible crib enclosure, which when in the open, use position is sized in length and width to enclose a crib and in height to permit an age and weight appropriate user to stand up in the crib.

2. A crib accessory according to embodiment 1, wherein when the enclosure is in the closed, collapsed position the enclosure is sized for portability.
3. A crib accessory according to embodiment 2, wherein when in the closed, collapsed position the enclosure fits into a portable storage bag.
4. A crib accessory according to any of embodiments 1-3, wherein, when in the open, use position, the crib enclosure has a length of greater than 40", a width of greater than 28", and a height of greater than 29".
5. A crib accessory according to embodiment 4, wherein the length is at least 40", at least 43", at least 51", at least 55", or at least 60"; the width is at least 29", at least 30", at least 31", at least 33", at least 35", or at least 40"; and, the height is at least 30", at least 33", at least 35", at least 40", at least 45", at least 50", at least 55", or at least 60".
6. A crib accessory according to embodiment 5, wherein the when in the open, use position, the crib enclosure has a length of about 66", a width of about 33", and a height of about 66" and when in the closed, collapsed position the crib cover has a diameter of at least about 25".
7. A crib accessory according to any of embodiments 1-6, wherein the enclosure is constructed to block light sufficiently to maintain a darkened environment.
8. A crib accessory according to any of embodiments 1-7, wherein the enclosure comprises fabric panels and an integrated support structure, wherein the fabric panels comprise a material which blocks light sufficiently to maintain a darkened environment and the support structure is configured to ensure the panels remain taut when the enclosure is in the open, use position.
9. A crib accessory according to any of embodiments 1-8, further comprising an accessory pocket for a monitoring device such as an audio, video or audio and video device.
10. A crib accessory according to any of embodiments 1-9, further comprising a removable top.
11. A crib accessory according to any of embodiments 1-10, wherein at least one side of the crib enclosure includes a window, which can be opened and closed from outside the enclosure.
12. A crib accessory according to embodiment 11, wherein the window is integrated with the crib cover.
13. A crib accessory according to embodiment 12, wherein the window has a mesh layer to alleviate or prevent entry of bugs while still providing ventilation.
14. A crib accessory according to any of the embodiments 1-14, wherein the enclosure is configured to provide UV protection.
15. A crib accessory according to embodiment 8, wherein the fabric panels comprise materials with UV protection.
16. A crib accessory according to embodiment 8 wherein at least a portion of the support structure is reversibly integrated with the fabric panels.
17. A crib accessory according to embodiment 16, wherein the fabric panels comprise one or more sleeves for receiving the support structure.
18. A crib accessory according to any of embodiments 1-17 wherein the accessory automatically pops up into the open use position when unfolded.
19. A crib accessory according to any of embodiments 1-18 further comprising an access panel sized to permit loading and unloading of an age-appropriate crib occupant and positioned to avoid compromising the stability of the accessory when in the open-use position.
20. A crib accessory, comprising: a self-supporting, pop-up pod for enclosing a crib, comprising:
    a. a bottomless, tent-shaped, fabric enclosure configured to isolate a crib in a room;
    b. a flexible, support frame configured:
        i. to keep the fabric taut when the enclosure is deployed over a crib,
        ii. to permit folding the enclosure into a compact size when collapsed, and
        iii. to cause the enclosure to pop-up into a tent shape when unfolded; and,
    c. one or more struts for stabilizing the enclosure in its upright position when deployed to enclose the crib, wherein the fabric enclosure and support frame define an open base sized to permit the enclosure to fit over a crib, and the fabric enclosure has a height sufficient to permit an age and weight-appropriate crib occupant to stand in the crib when the fabric enclosure is deployed to enclose the crib.
21. A crib accessory according to embodiment 20, wherein the fabric enclosure comprises:
    a. two pairs of opposing fabric sides, wherein:
        i. a first side of an opposing pair is similar in size and shape to a second side of the opposing pair; and,
        ii. each side has a base end and a top end with the base end being wider than the top end such that the joined sides form a rectangular open base and meet at or near an apex to form a cover having a height that permits an age and weight appropriate user to stand in the crib at least at the apex.
22. A crib accessory according to embodiment 21, wherein:
    a. the frame is shaped in a figure-eight pattern comprising a first loop, a second loop and a cross-over;
    b. the first loop has a top in a distal position relative the cross-over and the second loop also has a top in an opposing distal position relative the cross-over; and,
    c. the cross-over aligns with the apex of the fabric enclosure and the top of the first loop aligns at about the midpoint of the base of a first side of the fabric enclosure, and the top of the second loop aligns at about the midpoint of the base of a third side opposite the first side of the fabric enclosure.
23. A crib accessory according to embodiment 22 wherein the strut is at least a first, a second, a third and a fourth retractable stability leg, wherein:
    i. the first leg is rotatably connected to a first corner of the base of the fabric pavilion, wherein a first leg is rotatably connected to a first corner of the base of the fabric enclosure at one end and reversibly connects to a first side of the first loop at an opposite end;
    ii. the second leg is rotatably connected to a second corner of the base of the fabric enclosure at one end and reversibly connects to a second side of the first loop at an opposite end;
    iii. the third leg is rotatably connected to a third corner of the base of the fabric enclosure at one end and reversibly connects to a first side of the second loop at an opposite end; and,
    iv. the fourth leg is rotatably connected to a fourth corner of the base of the fabric enclosure at one end and reversibly connects to a second side of the second loop at an opposite end.

24. A crib accessory according to any of embodiments 22-23, wherein the top of each of the four sides of the fabric enclosure meet at the apex to form a closed cover.
25. A crib accessory according to any of embodiments 22-24, wherein the first loop is curve-shaped at least along the top and the second loop is curve-shaped at least along the top.
26. A crib accessory according to any of embodiments 22-24, wherein the first loop is has a flattened top extending at least along a portion of the base of the first side of the fabric pavilion and the second loop has a flattened top extending at least along a portion of the base of the third side of the fabric pavilion.
27. A crib accessory according to embodiment 23, wherein the strut comprises the first, second, third and fourth stability leg.
28. A crib accessory according to any of embodiments 20-27, wherein the pop-up pod folds down compactly enough to fit into a portable pouch dimensioned to permit the pod to be carried onto a plane.
29. A crib accessory according to embodiment 28, wherein the pop-up pod folds into an approximately circular shape having a diameter of about 25".
30. A crib accessory according to embodiments 28 or 29, wherein the fabric enclosure itself forms the pouch when folded and collapsed.
31. A crib accessory according to embodiments 28 or 29 further comprising a separate pouch for receiving and carrying the collapsed, folded pop-up pod.
32. A crib accessory according to any of embodiments 20-31, further comprising at least one reversibly openable panel in the fabric enclosure sized to permit a user to load and unload an age and weight-appropriate child into the crib when the crib accessory is deployed over the crib.
33. A crib accessory according to any of embodiments 20-27, further comprising at least one reversibly openable panel in the fabric enclosure sized to permit a user to load and unload an age and weight-appropriate child into the crib when the crib accessory is deployed over the crib, wherein the panel is positioned in either the second side, or the fourth side opposing the second side.
34. A crib accessory according to embodiment 33, wherein the panel extends from the apex ending approximately 24" above the base of the pop-up pod.
35. A crib accessory according to embodiment 23 further comprising a first pocket extending along a bottom portion of the first side and a second pocket extending along a bottom portion of the second size, wherein the pockets are sized to hold the stability legs when in a disconnected position.
36. A crib accessory according to embodiment 35, wherein the pockets are large enough to obscure the top of the loops.
37. A crib accessory according to any of embodiments 20-36, wherein the fabric enclosure comprises meshed portions positioned to facilitate airflow through the pop-up pod.
38. A crib accessory according to embodiment 37, wherein the meshed portion is at least a first meshed portion located toward the base of the pop-up pod and a second meshed portion located toward the top of the pop-up pod.
39. A crib accessory according to embodiments 37 or 38, wherein each of the meshed portions is optionally fitted with an openable flap sized to cover the meshed portion.
40. A crib accessory according to any of embodiments 20-39 wherein the fabric is a breathable, light-limiting material.
41. A crib accessory according to any of embodiments 20-39 further comprising an exterior pocket with a clear vinyl panel configured to hold a baby monitor while also permitting use of the baby monitor.
42. A crib accessory according to any of claims 20-41, wherein the fabric enclosure has an exterior and an interior and the flexible frame is positioned on the exterior of the fabric enclosure forming an exoskeleton.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

It should be noted that ratios, concentrations, amounts, and other numerical data may be expressed herein in a range format. It is to be understood that such a range format is used for convenience and brevity, and thus, should be interpreted in a flexible manner to include not only the numerical values explicitly recited as the limits of the range, but also to include all the individual numerical values or sub-ranges encompassed within that range as if each numerical value and sub-range is explicitly recited. To illustrate, a concentration range of "about 0.1% to about 5%" should be interpreted to include not only the explicitly recited concentration of about 0.1 wt % to about 5 wt %, but also include individual concentrations (e.g., 1%, 2%, 3%, and 4%) and the sub-ranges (e.g., 0.5%, 1.1%, 2.2%, 3.3%, and 4.4%) within the indicated range.

What is claimed is:

1. A pod configured to fit a play yard therein, comprising:

a pavilion comprising two pairs of opposing sides, wherein:

a first side of a pair is similar in size and shape to a second side of the pair;

wherein for at least one of the pairs each side has a base end and a top end with the base end being wider than the top end, wherein the sides are joined to form an open base configured to insert the play yard through the open base, thereby enclosing the play yard in the pod, and at least one of the sides comprises an access panel sized to permit loading and unloading of a size-appropriate occupant into the play yard when the pod is deployed over the play yard, wherein a window is included in or attached to the fabric pavilion, and wherein the window is configured to provide a baby monitor with visual access to the inside of the pod; and a flexible frame having a size and shape configured to fit the play yard therein and constructed to keep the pavilion in the open, use position.

2. The pod of claim 1, further comprising clips, wherein the flexible frame is configured to attach to the pavilion via the clips.

3. The pod of claim 1, further comprising ties or snap straps, wherein the flexible frame is configured to attach to the pavilion via the ties or the snap straps.

4. The pod of claim 1, wherein pavilion further comprises sleeves configured to receive the frame.

5. The pod of claim 1, wherein the top of each of the sides of the pavilion meet to form a closed cover.

6. The pod according to claim 1, wherein the first pair of opposing sides is wider at the base than the second pair of opposing sides, and the access panel is positioned in either of the sides comprising the first pair of opposing sides.

7. The pod according to claim 1, wherein one or more of the sides comprises one or more meshed portions positioned to facilitate airflow through the pavilion.

8. The pod according to claim 7, wherein the meshed portions comprise at least a first meshed portion located toward the toward the top of the pavilion.

9. The pod according to claim 1, wherein the window is an opening or clear material in a compartment, and is configured to provide the baby monitor with visual access to the inside of the pod when the baby monitor is inside the compartment.

10. The pod according to claim 1, wherein the pavilion has an exterior and an interior and the flexible frame is positioned on the exterior of the pavilion.

11. The pod of claim 1, wherein the pod has suitable dimensions to be lifted and placed over the play yard, thereby enclosing the play yard in the pod.

12. The pod of claim 1, wherein the flexible frame comprises first and second flexible poles, wherein the first flexible pole crosses over the second flexible pole at an apex of the pod.

13. The pod of claim 8, wherein the pod further comprises a removable fabric top portion, sized to cover the first meshed portion.

14. The pod of claim 12, wherein each end of the first and second flexible poles is configured to be inserted into pole connectors located at each corner of the base of the pod.

15. The pod of claim 1, wherein the flexible frame is further configured to permit collapse of the pod into a compact size.

16. The pod according to claim 1, wherein at least one of the sides includes a mesh portion to facilitate air flow through the pavilion, wherein the mesh portion can be opened and closed from the exterior of the pavilion.

17. The pod according to claim 1, wherein each side in one pair is joined to each of the opposing sides in the other pair, and wherein the open base has a rectangular shape.

18. The pod according to claim 1, wherein the window is configured to provide the baby monitor with visual access to the inside of the pod when the baby monitor is secured thereto.

19. The pod according to claim 1, wherein, when the pod is in an open, use position, the window is accessible from the exterior of the pavilion via an opening.

20. The pod according to claim 1, wherein when the pavilion is in the open, use position, a portion of the flexible frame is at or near the base end of the pavilion.

* * * * *